US012590259B1

(12) United States Patent
Merrill et al.

(10) Patent No.: US 12,590,259 B1
(45) Date of Patent: Mar. 31, 2026

(54) SYSTEMS AND/OR METHODS FOR PRODUCING PRODUCTS FROM CROP MATERIALS

(71) Applicant: WeNeW Carbology, LLC, Charlottesville, VA (US)

(72) Inventors: Matthew D. Merrill, Charlottesville, VA (US); Gregory Simms, Afton, VA (US); Khanh Dang, Ashburn, VA (US)

(73) Assignee: WENEW CARBOLOGY, LLC, Charlottesville, VA (US)

( * ) Notice: Subject to any disclaimer, the term of this patent is extended or adjusted under 35 U.S.C. 154(b) by 0 days.

(21) Appl. No.: 19/274,741

(22) Filed: Jul. 21, 2025

(51) Int. Cl.
*C10L 5/36* (2006.01)
*C10L 5/44* (2006.01)

(52) U.S. Cl.
CPC ..... *C10L 5/363* (2013.01); *C10L 5/361* (2013.01); *C10L 5/44* (2013.01); *C10L 2290/08* (2013.01)

(58) Field of Classification Search
CPC .. C10L 5/363; C10L 5/361; C10L 5/44; C10L 2290/08; F26B 21/00
USPC ..... 34/523
See application file for complete search history.

(56) References Cited

U.S. PATENT DOCUMENTS

| | | | | |
|---|---|---|---|---|
| 4,640,021 | A | 2/1987 | Gullickson | |
| 6,598,313 | B2 | 7/2003 | Beltrame | |
| 6,988,325 | B2 | 1/2006 | Philippe | |
| 7,334,345 | B2 * | 2/2008 | Lasonde | C02F 11/13 34/181 |
| 9,193,916 | B2 * | 11/2015 | Bar-Ziv | C10B 47/44 |
| 9,366,477 | B2 * | 6/2016 | Bux | F23G 5/04 |
| 9,410,450 | B2 * | 8/2016 | Näslund | F26B 3/06 |
| 9,562,720 | B2 * | 2/2017 | Huang | C09K 3/00 |
| 9,683,187 | B2 * | 6/2017 | Prud'Homme | C10L 5/40 |
| 10,036,592 | B2 * | 7/2018 | Chen | F26B 25/066 |
| 10,830,534 | B2 | 11/2020 | Martin | |
| 10,858,607 | B2 * | 12/2020 | Scalzo | C10L 9/08 |
| 10,933,427 | B2 * | 3/2021 | Vieslet | C10L 9/083 |
| 11,015,868 | B2 | 5/2021 | Gulbranson | |
| 11,143,454 | B2 * | 10/2021 | Triglia, Jr. | F26B 3/347 |
| 12,379,156 | B2 * | 8/2025 | Bos | A61L 2/025 |
| 2014/0007451 | A1 | 1/2014 | Brown | |
| 2021/0298239 | A1 | 9/2021 | Fehr | |
| 2023/0374390 | A1 * | 11/2023 | Atkins | C10L 3/103 |

FOREIGN PATENT DOCUMENTS

| | | | | |
|---|---|---|---|---|
| CN | 116829677 A * | 9/2023 | | C10G 3/46 |
| GB | 2599374 A * | 4/2022 | | C10L 5/442 |
| WO | WO12001461 | 1/2012 | | |
| WO | WO-2022063937 A1 * | 3/2022 | | C10L 5/442 |

* cited by examiner

*Primary Examiner* — Stephen M Gravini
(74) *Attorney, Agent, or Firm* — Michael Haynes PLC; Michael N. Haynes

(57) ABSTRACT

Certain exemplary embodiments can provide systems and/or methods for producing dried biomass materials, such as from bales of biomass. Biomass materials can be converted into, e.g., pellets, briquettes, cubes, and/or other products with dried and/or densified states. These dried, densified products can be used for, e.g., bioenergy and/or animal feed applications.

27 Claims, 7 Drawing Sheets

2000

Modified Oswald model:

$$M = (A + BT) \times \left[\frac{RH}{1 - RH}\right]^{\frac{1}{C}}$$

Where

M = biomass equilibrium moisture, weight %

RH = gas equilibrium relative humidity, weight %

A, B, C = empirical constants for biomass type (A = 10.6, B = -0.01, C = 1.9 for stover)

T = temperature, °C

SYSTEMS AND/OR METHODS FOR PRODUCING PRODUCTS FROM CROP MATERIALS

BRIEF DESCRIPTION OF THE DRAWINGS

A wide variety of potential, feasible, and/or useful embodiments will be more readily understood through the herein-provided, non-limiting, non-exhaustive description of certain exemplary embodiments, with reference to the accompanying exemplary drawings in which.

DESCRIPTION

Biomass materials can be converted into pellets, briquettes, cubes, and/or other products with dried and/or densified states. These products can be used for bioenergy and/or animal feed applications. The dry and/or densified conditions add valuable benefits, such as lower transportation costs, greater stability, and/or lower storage costs. The biomass materials can be initially captured as bales of harvested crops.

Certain exemplary embodiments can produce dried and/or densified products from baled biomass materials. Certain exemplary embodiments can avoid costs that might otherwise be incurred due to the seasonal nature of biomass material generation. Biomass materials can be generated with unstable and/or high moisture content. Moisture content greater than 15 weight percent can enhance degradation of biomass material quantity and/or quality, such as via microbial decomposition. Biomass degradation can include dry matter loss, reduced energy density, spoilage, molding, and/or rotting. For example, corn stover bales used for bioenergy can lose approximately 10-25% of dry matter during storage. Certain exemplary biomass processing options can avoid the costs of storing undried biomass materials by employing high-throughput processes for drying and/or densifying the biomass. High throughput processes can avoid costs by minimizing the storage times in which degradative losses of undried biomass can occur. Certain exemplary biomass processing options can store undried biomass for processing via a lower throughput equipment over longer timeframes.

Certain exemplary embodiments can uniquely dry biomass bales before storage as baled biomass. Certain exemplary embodiments can uniquely integrate the drying of biomass in the baled state near the onset of biomass storage, which can avoid performing one or more biomass drying steps after biomass storage.

Figure 1:
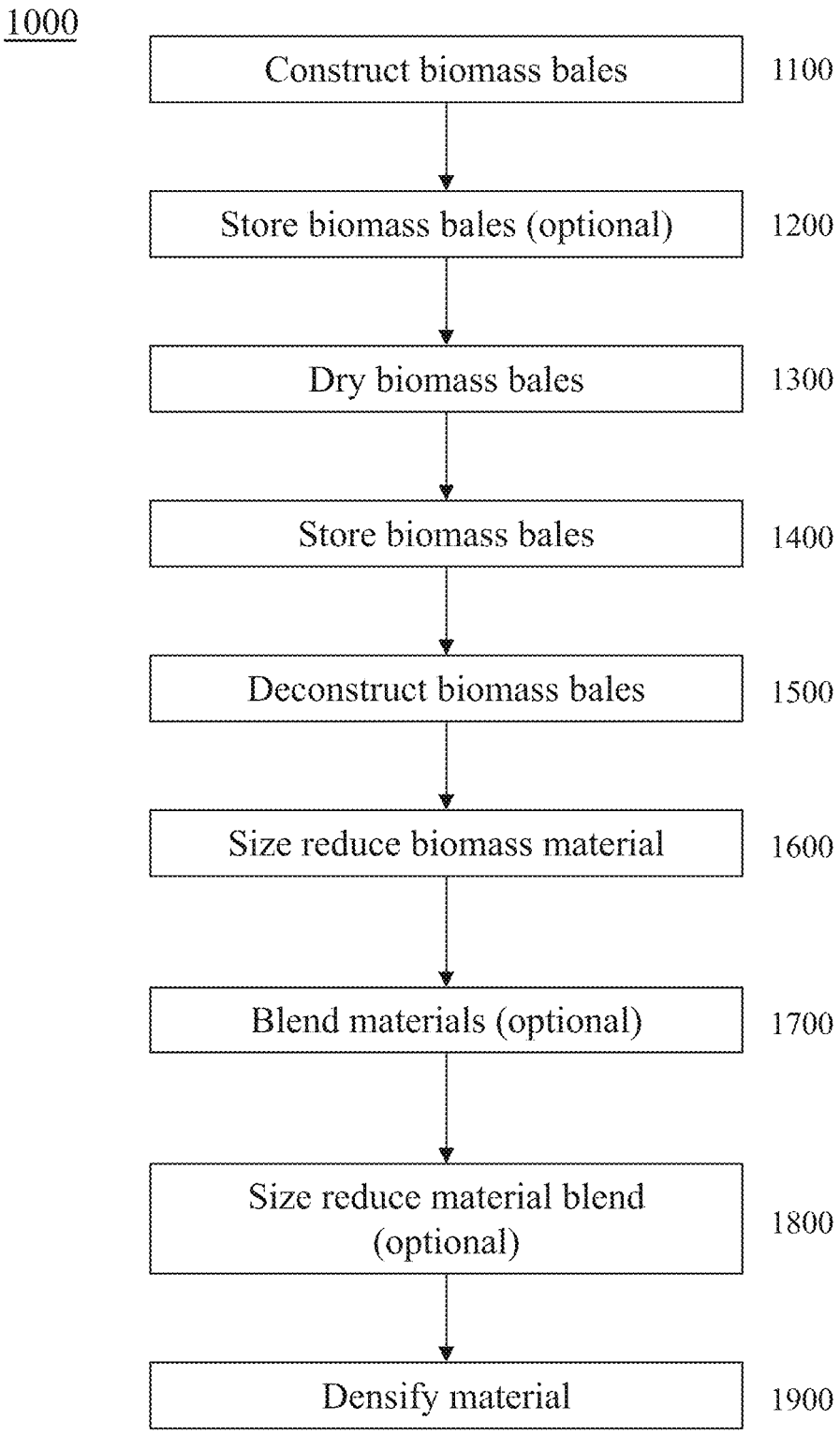
FIG. 1 is a block diagram of an exemplary embodiment of a system.

FIG. 1 is a general block flow diagram of an exemplary embodiment of a system and/or method 1000.

Biomass material can be initially captured as pre-dried bales 1100. Exemplary biomass materials can include corn stover, soy straw, wheat straw, hay, and/or other biomass materials. For ease of transportation and/or storage, these biomass materials can be packaged into bales via baling equipment that employes wire, twine, nets, wraps, and/or other packaging materials. In certain exemplary embodiments, the bales can be produced via multiple pass methods that can comprise combining, windrowing, and/or baling. In certain exemplary embodiments, the bales can be produced via single pass methods wherein the biomass material (other than grain) is transferred directly from a combine to the baler.

In certain exemplary embodiments, the biomass material can be dried while still packaged as a bale 1300. The energy density, nutrient density, durability, and/or other properties of the densified product can be adversely affected by higher moisture contents of the baled materials. In certain exemplary embodiments, the average moisture content of the dried bales can be less than 35 weight percent. In certain exemplary embodiments, the average moisture content of the dried bales can be less than 20 weight percent.

Figure 2:
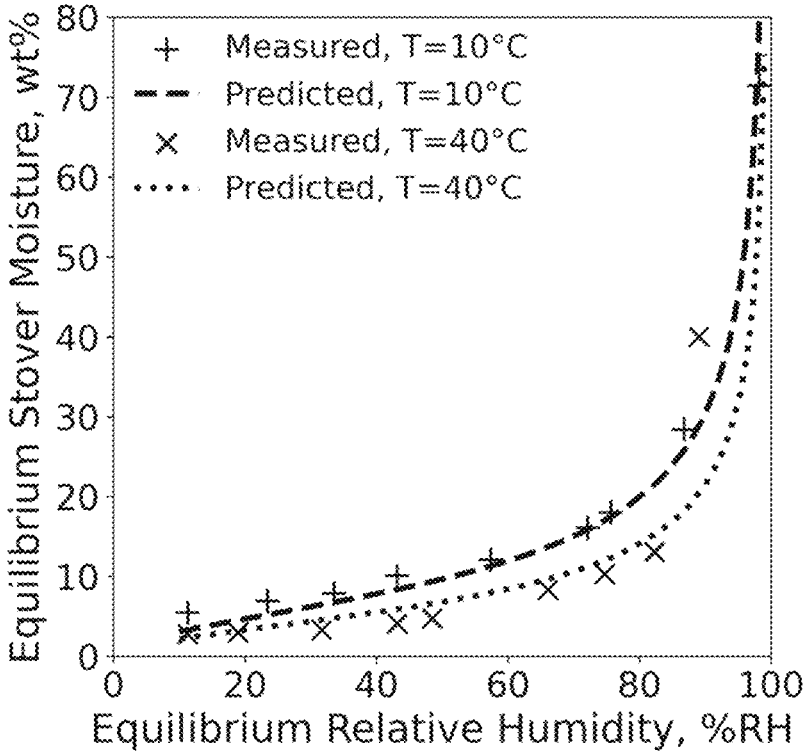
FIG. 2 is graph showing sorption equilibrium between an exemplary drying gas and an exemplary biomass.

In certain exemplary embodiments, the baled biomass material can be dried 1300 with a drying gas that can absorb and/or adsorb moisture from the biomass material and/or transport the moisture out of the bales. The drying gas can include at least one of air, heated air, combustion product gas, and/or a gaseous product of an industrial process. The weight percent (wt %) moisture of the biomass has an equilibrium with the percent relative humidity (% RH) of the drying gas. This equilibrium between drying gas relative humidity and biomass moisture content can have a dependence on temperature and/or biomass material type. FIG. 2 shows an example of experimentally and/or empirically determined temperature-dependent equilibrium between air relative humidity and corn stover biomass. A mathematical relationship, such as an Oswin model, a Henderson model, a Chung-Pfost model, a Halsey model, and/or other isotherm model can be used to describe experimentally determined sorption equilibria between a drying gas relative humidity, such as air, and a type of biomass material, such as corn stover. These sorption isotherm models can be modified to account for a dependence of the sorption isotherm on temperature. Biomass drying can occur if the relative humidity of the drying is less than the equilibrium relative humidity of the biomass moisture described by the sorption equilibrium model. Although sorption models can inform when to dry and/or when to stop drying, they do not necessarily inform how drying gas should be delivered to the bale stack. In any event, the moisture equilibria of these sorption isotherm models can be used to determine if and/or how much drying can occur for a given combination of biomass moisture, drying gas moisture, and/or temperature. A biomass drying control system and/or methods of use can be developed, designed, formulated, and/or automated to affect and/or modify the drying process in response to biomass moisture and/or drying gas moisture relationships mathematically described by a sorption model.

The rate and/or extent of biomass drying can be anticipated and/or controlled using the moisture equilibrium and/or sorption equilibrium model between drying gas and biomass. In certain exemplary embodiments, the drying gas can be applied with a relative humidity of less than 85 weight percent for sorbing and/or evaporating moisture from the baled biomass materials. In certain exemplary embodiments, the drying gas can be applied with a relative humidity of less than 75 weight percent. In certain exemplary embodiments, the drying gas can have a temperature of 150 degrees Celsius (C) or less. In certain exemplary embodiments, the drying gas can have a temperature of 80° C. or less. In certain exemplary embodiments, ambient air with a relative humidity (expressed as a weight percentage) lower than the equilibrium biomass weight percent moisture can be used as a drying gas. In certain exemplary embodiments, the supply of a drying gas to the biomass material can be turned on, turned off, and/or modulated in response to the temperature, pressure, velocity, humidity, and/or other drying gas properties. In certain exemplary embodiments that use ambient air as a drying gas, the air is supplied when the relative humidity is lower than a specified target (e.g. 75%) for reduction of biomass moisture to a specified target (e.g. less than or equal to 20%). In certain exemplary embodiments that use ambient air as a drying gas, the air is not supplied when the relative humidity is higher than a specified relative humidity target for reduction of biomass moisture. In certain exemplary embodiments that use ambient air as a drying gas with an actionable target relative humidity for reducing biomass moisture, the target relative humidity can be decreased during the biomass drying process. In certain exemplary embodiments, the temperature, velocity, pressure, relative humidity, and/or other property of the drying gas can be modified before, during, and/or after supply to the biomass.

The biomass drying process can be operated and/or controlled in response to the biomass moisture content. For example, the drying process can be turned on, turned off, and/or modulated in response to the biomass moisture. In certain exemplary embodiments, biomass moisture can be directly measured via oven drying, conductance-based, spectroscopic (e.g., infrared), and/or other method.

In certain exemplary embodiments, the biomass moisture can be determined via a hygrometer that measures the relative humidity of the biomass and/or the drying gas within and/or near the biomass and/or bale. For example, a SwitchBot wireless Indoor/Outdoor Thermo-Hygrometer (available from SwitchBot Inc. of Wilmington, DE) can be shallowly inserted into a bale to monitor biomass moisture and/or the moisture of the drying gas permeating that bale. As another example, the handheld HT-Pro electronic Hay Bale Moisture Tester (available from AgraTronix of Streetsboro, OH) can measure moisture levels at insertion depths of up to 32 inches inside of a bale, channel, and/or tube.

In certain exemplary embodiments, the biomass moisture content can be inferred via sorption equilibrium model by estimating how much biomass of a given moisture content can be dried to a predetermined moisture content by the supply of a drying gas with a given humidity over a given period of time.

In certain exemplary embodiments, the biomass moisture content can be inferred (such as via a sorption equilibrium model), statistically determined from direct measurements (such as via bale moisture content average, mean, median, mode, variance, standard deviation, distribution shape, etc., where the statistics are determined across samples taken at pseudo-random and/or predetermined locations and/or for minimum and/or predetermined sample sizes), and/or indirectly determined, such as from certain proxy and/or related metrics (e.g., absolute, relative, and/or time-varying metrics such as humidified gas temperature, humidified gas relative humidity, difference between supply gas relative humidity and ambient relative humidity, difference between ambient relative humidity and humidified gas relative humidity, rate of change of humidified gas relative humidity, rate of change of humidified gas temperature, supply gas flow rate, humidified gas flow rate, humified gas pressure at one or more predetermined locations, pressure differential between supply gas and humidified gas, difference between ambient temperature and humidified gas temperature, difference between bale exterior surface temperature and humidified gas temperature, biomass pH, and/or biomass degradation by-product concentration).

In certain exemplary embodiments, a pressure of 250,000 pascals or less can be applied to permeate the drying gas through the baled biomass material. In certain exemplary embodiments, a pressure of 50,000 pascals or less can be applied to permeate the drying gas through the baled biomass material. In certain exemplary embodiments, the drying gas can be applied with an average gas permeation rate of 10-1,000 standard liters per meter squared per second ($L/m^2/s$) or less within the baled biomass material. In certain exemplary embodiments, the drying gas can be applied with an average gas permeation rate of 30-300 $L/m^2/s$ within the baled biomass material.

In certain exemplary embodiments, the drying gas can be supplied by a drying gas supply system. The drying gas supply system can include one or more heat sources, one or more gas sources, one or more blowers, one or more heat exchangers, one or more ducts, one of more filters, one or more power sources, one or more sensors, and/or one or more control systems.

In certain exemplary embodiments, the drying gas can be applied to bales arranged in any of multiple configurations, including single bales, rows of bales, organized stacks of bales, disorganized piles of bales. In certain exemplary embodiments, the drying gas can be applied to one or more bales, including those having a cross-sectional shape that is round, square, ellipsoidal, or any other closed polygon. In certain exemplary embodiments, cylindrical bales (having a circular longitudinal cross-sectional area) can be stacked in a hexagonal close pack pattern, such that the longitudinal axis of each bale is substantially horizontal and/or substantially parallel to the longitudinal axis of each other bale.

Figure 3:
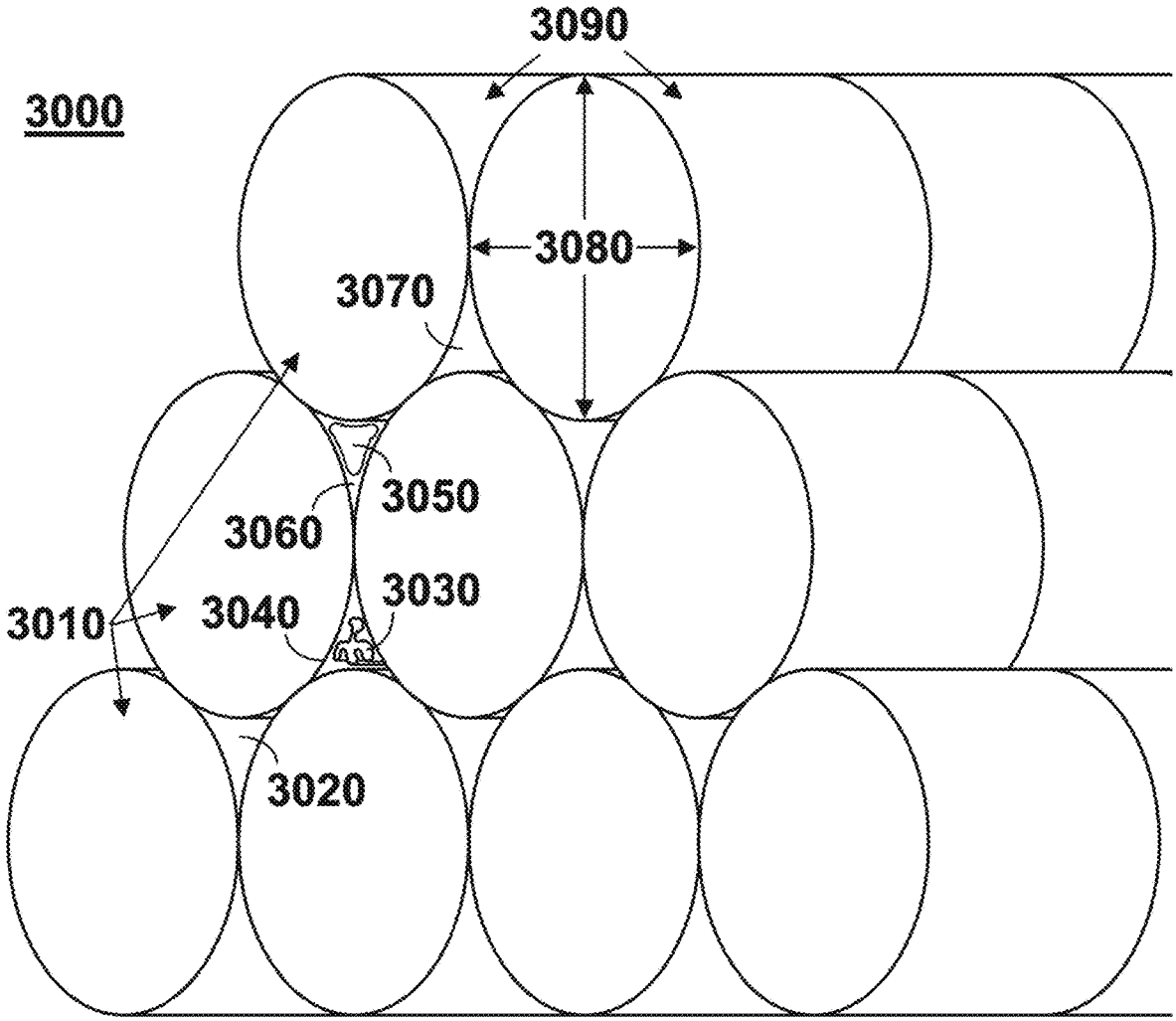
FIG. 3 is an end view of exemplary drying tubes integrated with a bale stack.

FIG. 3 presents an exemplary Bale Stack 3000 of cylindrical Bales 3010 (each substantially round/circular in longitudinal cross-section) stacked in a hexagonal close pack pattern that forms interstitial and/or inter-bale Channels 3020. In certain exemplary embodiments, round bales can be hexagonally close packed 3-100 bale rows wide, 3-20 bales deep per row, and/or 2-6 bale layers high, where the rotational axis of each bale is oriented substantially horizontally. In certain exemplary embodiments, more than one bale stack can be formed for the drying and/or storage steps.

Figure 4:
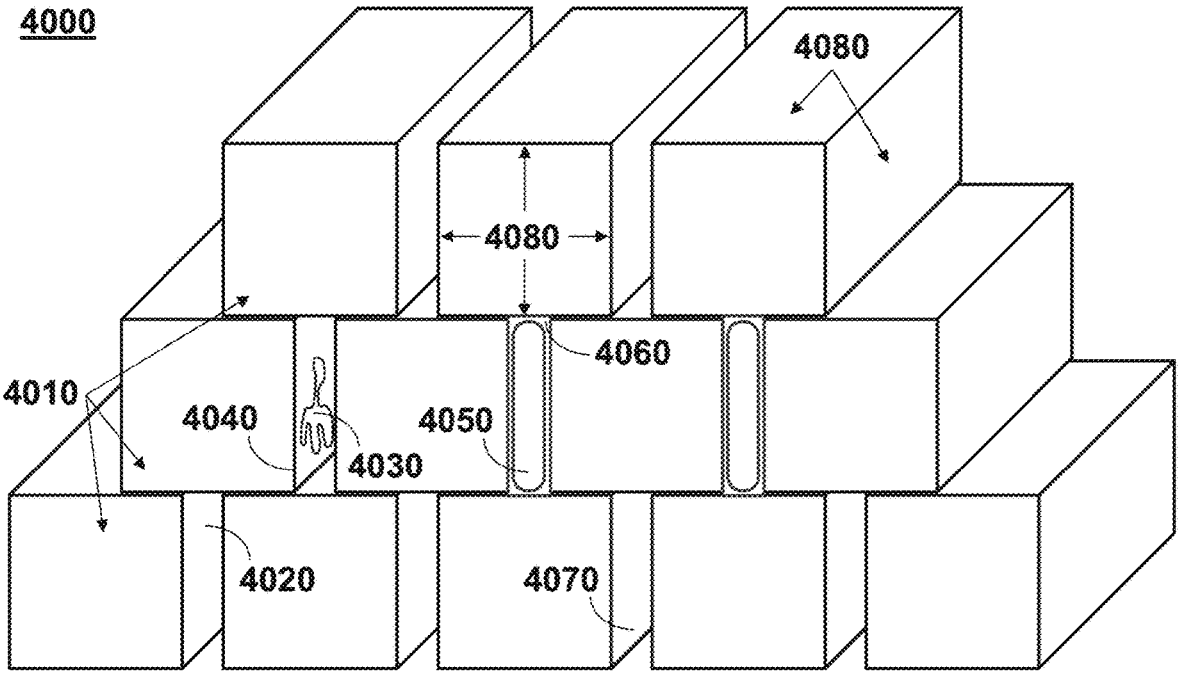
FIG. 4 is an end view of exemplary drying tubes integrated with a bale stack.

FIG. 4 presents an exemplary Bale Stack 4000 of square and/or rectangular Bales 4010 (each substantially square/rectangular in longitudinal cross-section) stacked in a pattern that forms interstitial and/or inter-bale Channels 4020. In certain exemplary embodiments, square and/or rectangular Bales 4010 can be stacked 2 to 100 bale rows wide, 1 to 20 bales deep per row, and/or 2 to 10 bale layers high. In certain exemplary embodiments, more than one bale stack can be formed for the drying and/or storage steps.

In certain exemplary embodiments, the drying gas can be applied to the baled biomass via one or more tubes constructed from, e.g., metal, plastic, rubber, ceramic, fabric, and/or other suitable materials. In certain exemplary embodiments, a tube can penetrate directly into the baled biomass material. In certain exemplary embodiments, the interstitial channels 3020 and/or 4020 formed by stacked bales can facilitate application of the drying gas to the baled biomass materials. The one or more tubes can be incorporated into the bale stack during assembly of the bale stack, inserted (e.g., into the channels) after bale stack assembly, removed before bale stack disassembly, and/or removed during and/or after bale stack disassembly.

In certain exemplary embodiments, the tubes can be substantially non-destructively inflatable and/or deflatable. In certain exemplary embodiments, the gas pressure applied to a tube can cause the tube to inflate. When installed in a channel, the one or more flexible surfaces of a tube can increase contact and/or conformation between one or more of those surfaces and an external surface of one or more bales that define the channel. One or more passages can be defined in a wall of a tube, such as by, e.g., manmade apertures, material porosity, and/or other fluid permeation features that facilitate transfer of the drying gas from within the tube, through the wall of the tube, to the outside of the tube, and thereby into the channel for application to the bales.

As shown in FIG. 3 or FIG. 4, Interstitial Channels 3020 or 4020 can be formed by the stacking of Bales 3010 or 4010 into Bale Stack 3000 or 4000, respectively. A substantially Deflated Tube 3030 can be inserted into an Interstitial Channel 3020 or 4020 defined by Bale Channel Surfaces 3040 or 4040 of adjacent Bales 3010 or 4010, respectively. Delivered gas(es) can be supplied to an inserted Deflated Tube 3030 or 4030 to form an Inflated Tube 3050 or 4050, respectively, which can be partially and/or completely inflated. The partial and/or complete inflation of Inflated Tube 3050 or 4050 can increase the conformation of one or more outer surfaces of Inflated Tube 3050 or 4050 with one or more Bale Channel Surfaces 3040 or 4040, respectively, which can increase the degree that delivered gas(es) permeate through the biomass material of Bales 3010 or 4010 and/or decrease the degree that delivered gas(es) exit Bale Stack 3000 or 4000, respectively, via Inlet Channel Gaps 3060 or 4060, respectively. Some Interstitial Channels 3020 or 4020 can remain substantially empty to function as Exhaust Channels (aka vents, ducts, and/or conduits) 3070 or 4070, respectively, for the humidified gas(es) to exhaust (e.g., from Bale Stack 3000 or 4000 to ambient and/or to within a bale storage enclosure and/or facility). After a predetermined time period of delivering dried gas(es) to Bale Stack 3000 or 4000, one or more Inflated Tube 3050 or 4050, respectively, can be deflated, removed, inserted into Interstitial Channels 3020 or 4020 defined by the same or different Bales 3010 or 4010 (of the same or a different Bale Stack 3000 or 4000), reinflated, and/or used to deliver drying gas(es).

Increased confirmation between the Inflated Tube 3050 or 4050 surface and the Bale Channel Surfaces 3030 or 4030, respectively, improves drying performance. This increase in conformation between the Inflated Tube 3050 or 4050 surface and the Bale Channel Surfaces can increase the cross-sectional area of the Inflated Tube 3050 or 4050 and/or decrease the cross-sectional areas of the Inlet Channel Gaps 3060 or 4060, respectively. A decrease in the cross-sectional area of the Inlet Channel Gap 3060 or 4070 can increase the resistance of drying gas flow through the length of the Inlet Channel Gap 3060 or 4060, respectively. This increase in drying gas flow resistance through the length of the Inlet Channel Gap 3060 or 4060 can cause a diverting pressure effect that increases the flow of drying gas to a Humidified Gas(es) Exhaust Channel 3070 or 4070, respectively, the Bale Face 3080 or 4080 outer surface, and/or Bale Outer Surface 3090 or 4090. In certain embodiments, the cross-sectional area Inflated Tube 3050 or 4050 comprises 50% or more of the cross-sectional area of the Interstitial Channel 3020 or 4020, respectively. In certain embodiments, the cross-sectional area Inflated Tube 3050 or 4050 comprises 75% or more of the cross-sectional area of the Interstitial Channel 3020 or 4020, respectively. In certain embodiments, inflation of the tube can increase the cross sectional area of the tube by 5% or more. In certain embodiments, the reduction in Interstitial Channel 3020 or 4020 cross-sectional area resulting from increased confirmation between the Inflated Tube 3050 or 4050 surface, respectively, and the Bale Channel Surfaces improves drying performance and decreases the amount drying gas exiting Bale Stack 3000 or 4000, respectively, via an Inlet Channel Gap 3060 or 4060 to 40% or less of drying gas supplied to the interior of Inflated Tube 3050 or 4050, respectively. In exemplary certain embodiments, the reduction in Interstitial Channel 3020 or 4020 cross-sectional area resulting from increased confirmation between the Inflated Tube 3050 or 4030 surface, respectively, and the Bale Channel Surfaces improves drying performance and decreases the amount drying gas exiting Bale Stack 3000 or 4000 via an Inlet Channel Gap 3060 or 4060 to 15% or less of drying gas supplied to the interior of Inflated Tube 3050 or 4050, respectively.

In certain exemplary embodiments, the porosity of the tube can permeate the drying gas at 2-200 $L/m^2/s$ with pressures of 20-2,000 pascals (Pa). In certain exemplary embodiments, tube permeabilities can be 0.01-5 $L/m^2/s/Pa$ to cause the resistance of gas flow through the one or more tube surfaces to be greater than the resistance of gas flow down the inside length of the tube. In certain exemplary embodiments, the tube permeabilities can be 0.05-0.5 $L/m^2/s/Pa$. In certain embodiments, the tube length can be 1-30 m. In certain exemplary embodiments, the tube length can be 2-10 m.

In certain exemplary embodiments, the pressure of the drying gas traveling through the volume defined within an inflated tube can be greater than or equal to the pressure of the drying gas that is presented to and/or permeating through the bale biomass. In certain exemplary embodiments, the gas flow resistance and/or pressure drop experienced by gas flowing through the wall of the tube, gas flowing within, along, and/or down the inside length of the tube and/or through the volume defined within the tube, gas flowing along and/or down the outside length of the tube (i.e., through an Inlet Channel Gap(s)), and/or gas flowing through the bale biomass, can be controlled, changed, increased, and/or decreased to manage, change, increase, and/or decrease the uniformity of drying gas distribution throughout the baled biomass. In certain exemplary embodiments, the relative difference in gas flow resistance and/or pressure drop experienced by gas flowing through the wall of the tube, with respect to gas flowing within, along, and/or down the inside length of the tube and/or through the volume defined within the tube, with respect to gas flowing along and/or down the outside length of the tube, and/or with respect to gas flowing through the bale biomass, can be controlled, changed, increased, and/or decreased to manage, change, increase, and/or decrease the uniformity of drying gas distribution throughout the baled biomass.

In certain embodiments, a 250,000 Pa or less difference in drying gas pressure between the Inflated Tube 3050 inner surface and the inner surface of a Humidified Gas(es) Exhaust Channel 3070, the Bale Face 3080 or 4080 outer surface, and/or Bale Outer Surface 3090 or 4090 can enable a pre-determined distribution of gas permeation through the Bale Stack 3000 or 4000, respectively. In certain exemplary embodiments, a 50-1,000 Pa difference in drying gas pressure between the Inflated Tube 3050 or 4050 inner surface and the inner surface of a Humidified Gas(es) Exhaust Channel 3070 or 4070, the Bale Face 3080 or 4080 outer surface, and/or Bale Outer Surface 3090 or 4090 can enable a predetermined distribution of gas permeation through the Bale Stack 3000 or 4000, respectively.

Figure 5:
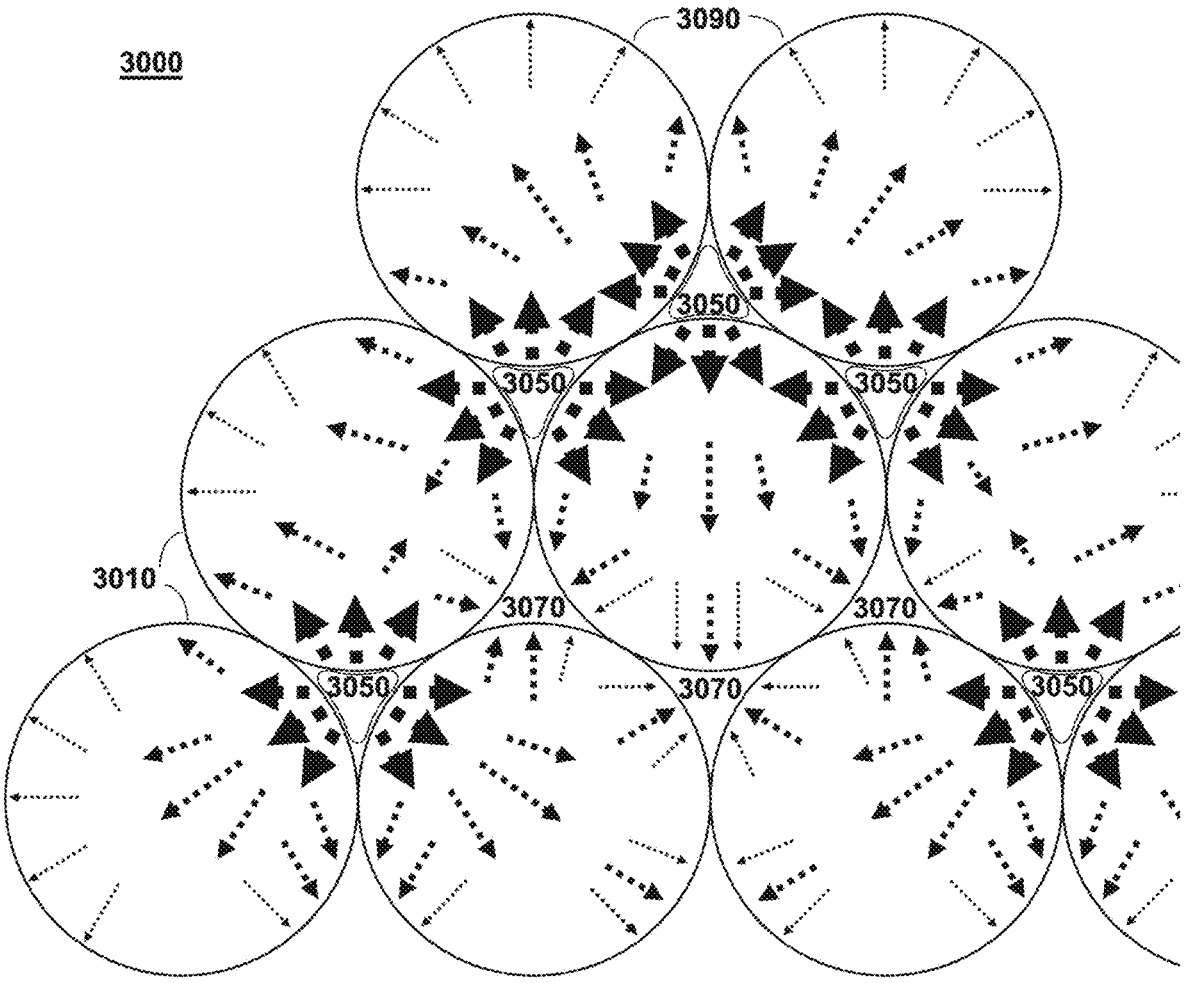
FIG. 5 is an end view of an exemplary bale stack.
Figure 6:
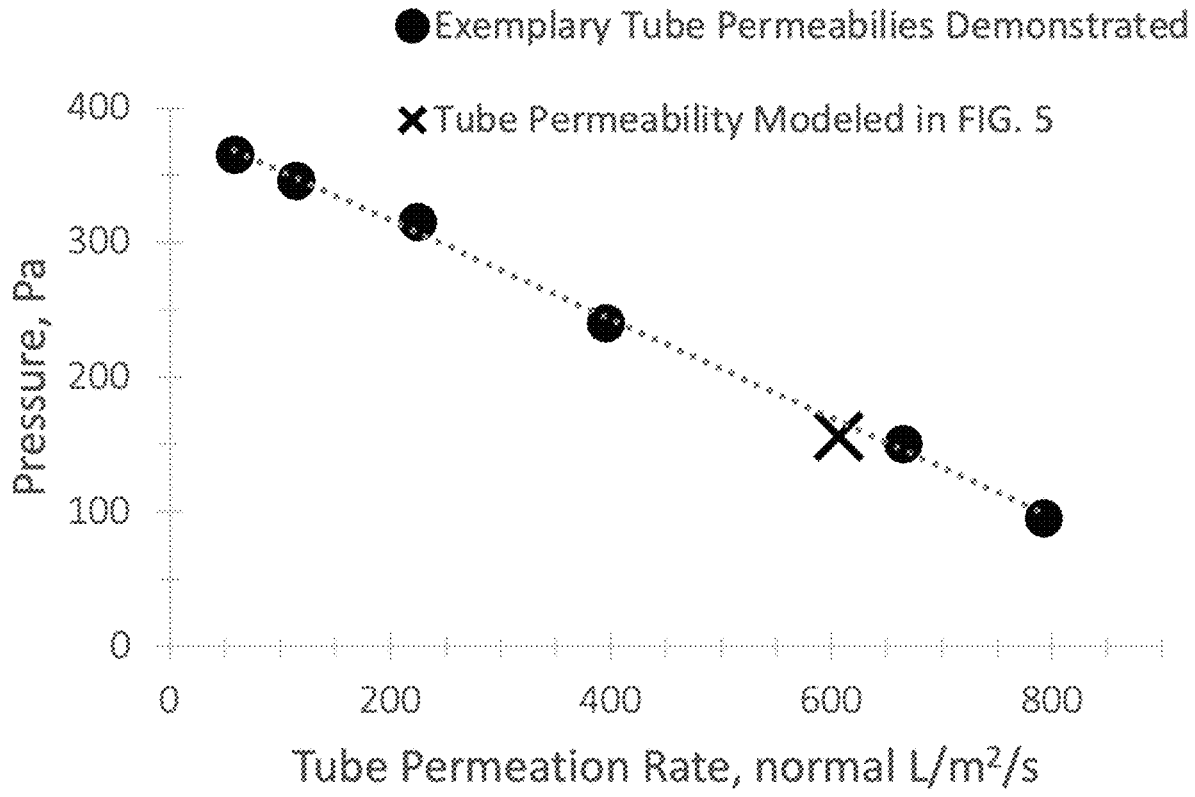
FIG. 6 is graph of exemplary drying tube permeability.

FIG. 5 is an end view of an exemplary round bale stack showing the modeled direction and/or permeation rates of a drying gas through the stack. The drying gas permeation rates can decrease when passing between the Inflated Tube 3050 inner surface and the inner surface of a Humidified Gas(es) Exhaust Channel 3070, the Bale Face 3080 outer surface, and/or Bale Outer Surface 3090 because the cross-sectional area of the drying gas permeation path through the Bale Stack 3000 can increase. The drying gas flow can be assumed to be substantially laminar within the Inflated Tube 3050 and/or the Humidified Gas(es) Exhaust Channel 3070. The porosity of the biomass within the Bales 3010 can be assumed to be substantially constant for a given type of biomass and/or bale construction process. Prior to drying, the moisture content of the biomass within the Bales 3010 can be assumed to be substantially constant for a given type of biomass, material conditions of the biomass, bale construction process, and/or environmental conditions of the bale construction process. FIG. 6 is graph of exemplary drying tube permeability modeled in FIG. 5.

Bales 3010 or 4010 can be gathered, placed, and/or organized into Bales Stacks 3000 or 4000, respectively, (e.g., groupings, collections, configurations, arrangements, or the like) that can define inter-bale channels that can serve as inlet and/or outlet channels for the drying gas. The drying gas can absorb moisture from the biomass during the drying process, which can increase the drying gas relative humidity. The absorbed moisture can be condensed onto the biomass if the relative humidity of the drying gas increases to 100%. Increasing the relative humidity of the drying gas can cause moisture reabsorption and/or readsorption by the biomass as defined by the sorption equilibrium between biomass weight percent moisture and the relative humidity of the drying gas. Moisture removed from the biomass by the drying gas need not be transferred back to the biomass at a different location before exiting the bale stack. Substantial uniformity of weight percent moisture within a bale and/or bale stack sometimes can be desirable for the drying process. Patterns and/or flow rates of drying gas flow through the bales and/or through the bale stack can be designed to facilitate substantial uniformity in moisture removal from the bales and/or bale stack. In certain exemplary embodiments, this uniformity in drying can be characterized by a final moisture content variation across different bales and/or bale regions of less than +/−8%. In certain exemplary embodiments, the moisture variation can be less than +/−4%. This substantial uniformity can be achieved via relative uniformity in the distances between the Inflated Tube 3050 or 4050 inner surface and the inner surface of a Humidified Gas(es) Exhaust Channel 3070 or 4070, the Bale Face 3080 or 4080 outer surface, and/or Bale Outer Surface 3090 or 4090, respectively, due to the aforementioned assumptions concerning substantial uniformity in Bale 3010 or 4010 porosity.

Larger Bale Stacks 3000 or 4000 can increase the distance from one or more of Inflated Tube 3050's or 4050's surfaces, respectively, to one or more of Bale Face 3080's or 4080's surfaces and/or one or more of External Bale Surfaces 3090 or 4090. The incorporation of Humidified Gas(es) Exhaust Channels 3070 or 4070 can substantially improve the uniformity of drying gas flow distances from the Inflated Tube 3050 or 4050 surface to a Humidified Gas(es) Exhaust Channel 3070 or 4070 surface, a Bale Face 3080 or 4080 surface, and/or a External Bale Surface 3090 or 4090, respectively. In certain exemplary embodiments, the inlet channels can be substantially parallel with respect to the outlet channels. In certain exemplary embodiments, 15 percent to 85 percent (including all values therebetween (e.g., 20, 24.95, 30.01, 35, 40, 49.77, 50, 66.7, and/or 75 percent) and all subranges therebetween) of the bale stack channels of Bale Stack 3000 or 4000 and/or within a proximity of 7 m of Inflated Tube 3050 or 4050, respectively, can function as outlet channels. In certain exemplary embodiments, 35 percent to 60 percent (including all values therebetween (e.g., 37.5, 40, 45.3, 49.77, 50, and/or 55.55 percent) and all subranges therebetween) of the bale stack channels of Bale Stack 3000 or 4000 and/or within a proximity of 7 m of Inflated Tube 3050 or 4050, respectively, can function as outlet channels. In certain exemplary embodiments, the average distance that the drying gas permeates through the bale material from inlet channel to outlet channel can be less than 3 m.

In certain embodiments, a tube can be formed from one or more fabrics, one or more rubbers, one or more plastics, one or more foams, one or more composites, and/or one or more other materials. In certain exemplary embodiments, a tube can be formed from a tarpaulin-reinforced polyester and/or polyamide nylon silk fabric having a permeability that can be controlled via the fabric's weave specifications and/or via apertures applied to the fabric, such as by perforating, punching, drilling, piercing, laser-cutting, eroding, blasting, etching, etc. Some portion of the fabric can be coated with, e.g., 1000D PVC. For example, the tube and/or blowers of certain inflatable advertisement displays (e.g., from Banner Buzz of Suwanee, Georgia) can be modified for application to bale drying as described herein.

In certain exemplary embodiments, one or more blowers can be used to supply the drying gas to one or more tubes. Each blower can comprise a centrifugal blower, axial blower, radial blower, compressor, fan, forced draft fan, induced draft fan, air handler, and/or air mover. In certain embodiments, a manifold can connect one or more blowers with one or more tubes. In certain exemplary embodiments, a single blower is connected to a single tube. The tube connection can be comprised of, but not limited to, Velcro, compression fittings, zippers, and/or adhesives. In certain embodiments, the blower can move the drying gas at a bulk and/or average flow rate of 50-50,000 normal $L/m^2/s$ per tube. In certain exemplary embodiments, the blower can move the drying gas at a bulk and/or average flow rate of 200-5,000 normal $L/m^2/s$ per tube.

In certain exemplary embodiments, a tube can be incorporated, unincorporated, inserted, and/or removed from the bale stack. A tube can be incorporated into the bale stack by placing the tube in a bale stack channel during the bale stacking process. A tube can be unincorporated from the bale stack by removing the tube from a bale stack channel during the bale unstacking process.

In certain exemplary embodiments, a tube can be inserted into a bale stack channel after the bale stack channel has been formed by the bale stacking process. In certain exemplary embodiments, a tube can be inserted into the bale stack channel in a deflated state. In certain exemplary embodiments, a deflated tube can be inserted into a bale stack channel already formed via a bale stacking process. A tube can be removed from a bale stack channel before and/or after unstacking the bales. In certain exemplary embodiments, a tube can be removed from the bale stack channel in a deflated state before the bale stack is unstacked. In certain exemplary embodiments, the bale drying process can comprise inserting a deflated tube into a bale stack channel defined within an existing bale stack, inflating the tube, performing the drying process via application of drying gas, deflating the tube, removing the tube, and/or moving the tube to a different bale stack channel of the same or a different bale stack. In certain exemplary embodiments, drying can be performed via an inserted tube immediately following formation of the channel via the bale stacking process. In certain exemplary embodiments, drying can be performed via an inserted tube 1 or more days after formation of the channel via the bale stacking process to enhance uniformity of the drying process throughout a bale and/or bale stack. For example, the viscoelastic properties of baled biomass can deform the bale shape over time to increase the areas of contact between bales, which can shift drying gas permeation towards the center of the bales. In certain exemplary embodiments, drying can be performed via an inserted tube 3 or more days after formation of the channel via the bale stacking process to lower the quantity of equipment required to dry one or more bale stacks. For example, one or more tubes can be used to dry an initial portion of a bale stack and then moved to dry another portion of a bale stack. In certain exemplary embodiments, bale stacks are formed in the summer, fall, and/or winter following a crop harvest. The rate of biomass quality loss during storage can be a function of environmental temperature because lower temperatures can slow biomass decomposition rates. In certain exemplary environments, the rate of biomass decomposition during winter can be acceptably slow. In certain exemplary scenarios, such as when lower ambient temperatures are expected, the rate of bale stacking and/or drying of bale sections can be lowered to minimize the quantity of drying equipment and/or the degree of bale stack enclosement required to substantially complete biomass drying before a predetermined date and/or environmental temperature. In certain exemplary embodiments, the time period between stacking of a bale and completion of drying can be less than 150 days.

In certain exemplary embodiments, the weights of the tube and/or air blower can be 10's-1,000's of time less than the weight of the bale stack, bale stacks, and/or biomass being dried by the drying units. The logistical costs of bale drying can therefore often be reduced by moving the drying units (e.g., tubes and/or blowers) to the bales and/or bale stack instead of moving bales to the drying units.

In certain exemplary embodiments, a tube positioning tool can be used to facilitate the tube insertion and/or removal processes. The features of the tube positioning tool can include, but are not limited to, a rod, a shaft, a pole, a guide wire, a rope, a zip tie, a hook, a loop, and/or a fastener for attaching to an end of the tube. For example, one end of the tube can be sealed off by cinching with a zip tie at a lip located in the end of the tube. A second zip tie then can be anchored to the first zip tie to form a loop. With the zip ties in position and the loop formed, a pole with a hook on one end can be fed down the bale stack channel, the loop placed onto the hook, and the pole pulled back out of the channel to pull the uninflated tube down the length of the channel.

In certain exemplary embodiments, a blower can be incorporated, unincorporated, and/or moved to one or more locations of the bale stack. In certain exemplary embodiments, the application of a blower can correlate with the transfer of one or more tubes to one or more bale stack channels. The distance between the blower and the bale can be minimized by positioning the blower at the end of a bale stack channel. In certain embodiments, the end of bale stack channels can be located 0-12 m in height from the level of the bottom of the bale stack. In certain embodiments, the blower unit can be vertically positioned near the bale stack channel with equipment comprising stands, racks, scaffolds, ropes, wires, cables, hooks, and/or fasteners. In certain exemplary embodiments, when the bale stack channel is located under a roof, a cable fastened to the roofing structure can be used to vertically suspend the blower. In certain exemplary embodiments, when a cable is used to suspend the blower, the electrical cord used to power the blower can be associated with the suspension cable via mechanisms comprising ties, fasteners, coiling, and/or wrapping. In certain exemplary embodiments, when a cable is used to suspend the blower, a pully system can be configured to position the blower. In certain exemplary embodiments, a blower can be vertically mounted on the side of the bale stack via mechanisms than can include, but are not limited to, hooks, rods, fasteners, and/or anchors. In certain exemplary embodiments, blower positioning equipment can comprise ladders, scaffolds, lifts, booms, telehandlers, and/or excavators.

In certain exemplary embodiments, the bale stack can be located within an enclosure during drying and/or storage. The enclosure can function to reduce exposure of the bale stack to precipitation, adsorption of moisture from the ground, and/or damage from weather and/or climatic effects. The enclosure can function to ventilate and/or structurally stabilize the bale stack during drying and/or storage. The enclosure can have one or more roofs, one or more tarps, one or more wraps, one or more walls, one or more floors, one or more foundations, one or more doors, one or more ducts, and/or one or more vents. In certain embodiments, the bale stack and/or bale drying equipment can be enclosed by a metal roof with one or more open walls and/or with gravel flooring. In certain embodiments, the bale enclosure can measure from 3-60 m wide, 3-200 m long, and/or 3-20 m tall. In certain exemplary embodiments, the bale enclosure can measure from 6-20 m wide, 10-100 m long, and/or 6-10 m tall. In certain exemplary embodiments, one or more aisles can be formed between bale stacks positioned within an enclosure. In certain exemplary embodiments, more than one enclosure can be used for the drying and/or storage steps. Upon completion of the drying process, the bales can undergo storage within the bale stack and/or enclosure and/or the bales can be moved to a new location.

In certain exemplary embodiments, any portion of the bales can be stored prior to bale deconstruction 1400. For example, a fraction of corn stover bales constructed in the fall season can be stored through winter and spring seasons until processing into densified biomass units in the summer. A fraction of bales can be stored prior to drying. For example, a fraction of corn stover bales constructed in the fall can be optionally stored 1200 several weeks before drying 1300.

In certain exemplary embodiments, a bale can be deconstructed 1500 into loose biomass material particles prior to densification. Bales can be deconstructed by a bale shredder, bale grinder, bale mixer, bale unroller, and/or other bale processing equipment. In certain exemplary embodiments, bale deconstruction can include removing any wire, twine, nets, wraps, and/or other bale packaging materials. In certain embodiments, a conveyor can transfer the bales to bale deconstruction. In certain exemplary embodiments, the bale conveyor can temporarily store enough bales to meter the bales and/or bale materials to the downstream process steps over a 4-40 hour period. In certain embodiments, the downstream size reduction and/or densification steps can be performed at average processing rates of 0.2-10 tonnes per hour on a dry mass basis. In certain exemplary embodiments, the downstream size reduction and/or densification steps can be performed at average processing rates of 0.5-4 tonnes per hour on a dry mass basis. In certain embodiments, the bale deconstruction, size reduction, and/or densification steps can be performed via 60% or greater annual equipment operating capacity, which can be defined by the % of total number of hours the equipment is operated per total number of hours per year. In certain exemplary embodiments, the bale deconstruction, size reduction, and/or densification steps can be performed via 80% or greater annual operating capacity.

In certain exemplary embodiments, the loose biomass material particles can undergo size reduction 1600. In certain exemplary embodiments, a size distribution (i.e., an average and/or maximum mass, an average and/or maximum volume, an average and/or maximum cross-sectional area, and/or an average and/or maximum dimension (length, width, and/or height, as measured in any predetermined and/or undetermined direction)) of the biomass material particles can be reduced by the combine, baler, and/or other equipment involved with bale construction. In certain exemplary embodiments, the average size of the biomass material particles can be reduced during and/or after bale deconstruction. The average size of the biomass material particles can be reduced with bale processors, bale shredders, tub grinders, hammer mills, rotary sheers, flails, grinders, mills, and/or other size-reduction equipment. In certain exemplary embodiments, the variation of the biomass material particle sizes can be reduced during and/or after bale deconstruction. The size distribution of biomass material particles can be reduced with screens, filters, sieves, air knives, cyclones, and/or other separation equipment. The extent of biomass material size reduction can be dependent upon a pre-reduction or post-reduction mass, volume, cross-sectional area, dimension, composition, temperature, moisture content, density, and/or shape of the loose biomass material and/or the densified product. For example, densified products with relatively smaller volumes and/or dimensions can benefit from greater reductions in loose biomass material particle sizes. In certain exemplary embodiments, the size distribution of loose biomass material particles, such as a maximum or average dimension, can be reduced to less than 40 millimeters. In certain exemplary embodiments, the average and/or maximum dimension of the loose biomass material particles can be reduced to a maximum or average particle dimension of less than 8 millimeters.

The biomass material can be blended 1700 with one or more additives before densification into a finished biomass product. In certain embodiments, the additives can comprise water, one or more solvents, one or more binders, one or more other species of biomass material, one or more vitamins, one or more nutrients, one or more catalysts, one or more sorbents, and/or one or more anti-slagging agents. In certain exemplary embodiments, the other species of biomass blended include, but are not limited to soy meal, dried distillers grain, straw, husks, alfalfa, cotton gin residues, whey, and/or peanut hulls. In certain exemplary embodiments, the blending can be performed before, during, and/or after biomass size reduction. In certain exemplary embodiments, the moisture content of the biomass particles can be tuned to accommodate the biomass species composition and/or densification pressure such that any additives are blended with the biomass to produce stable and/or durable densified biomass products. In certain exemplary embodiments, the moisture content of the blended biomass is 4-20 wt %. In exemplary certain embodiments, the moisture content of the blended biomass is 8-16 wt %.

Biomass densification can improve the performance, stability, transportability, durability, and/or other biomass product features. The biomass material can be densified 1800 into a finished product in the shape of a pellet, briquette, cube, cylinder, sphere, ellipsoid, etc. In certain embodiments, the biomass can be densified via an applied pressure of 50 megapascals (MPa) or greater. In certain exemplary embodiments, the biomass can be densified via an applied pressure of 100 megapascals (MPa) or greater. In certain exemplary embodiments, the product density can be 0.4 $g/cm^3$ or greater. In certain exemplary embodiments, the product density can be 0.6 $g/cm^3$ or greater. In certain embodiments, the maximum product dimension can be 3-300 millimeters. In certain embodiments, the maximum product dimension can be 10-100 millimeters. In certain exemplary embodiments, the densified biomass products can be cooled, heated, screened, sorted, metered, stored, conveyed, and/or transported.

Certain exemplary embodiments can include at least one apparatus, machine, system, manufacture, composition of matter, and/or method configured for drying baled biomass to produce one or more densified biomass products.

Figure 7:
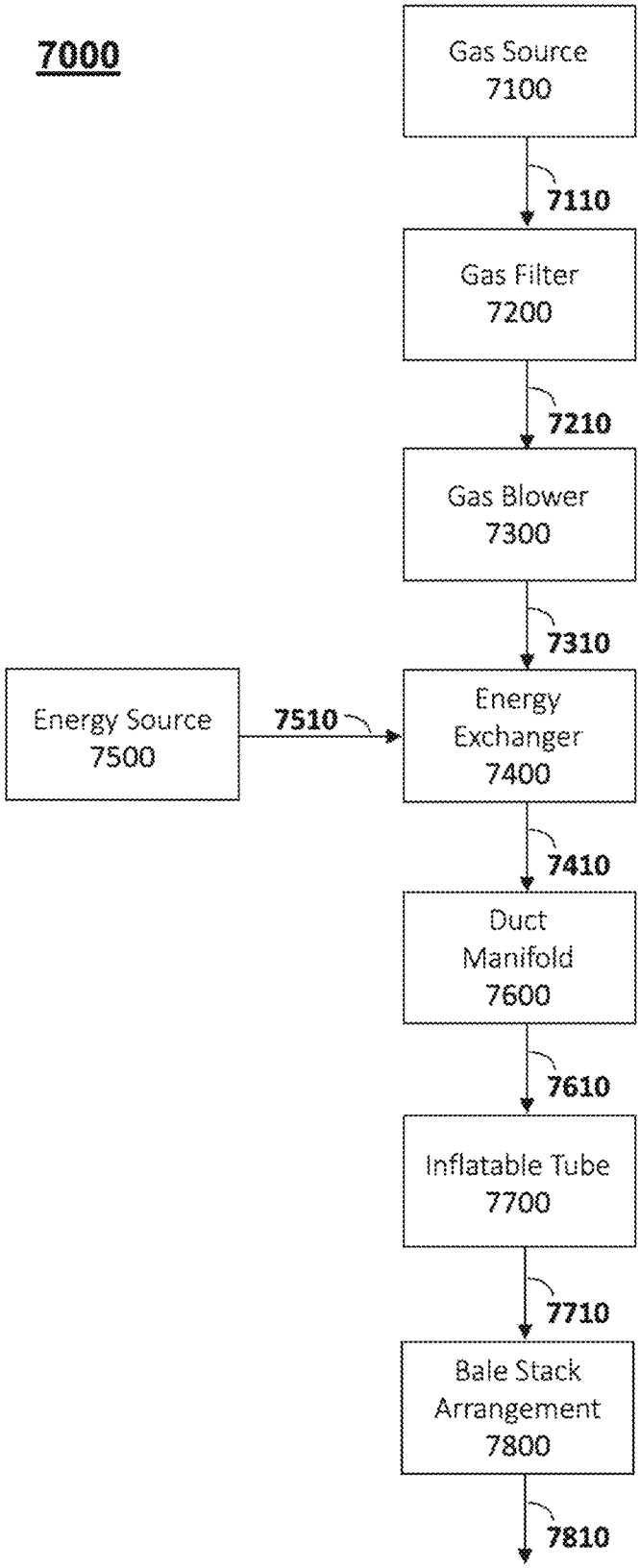
FIG. 7 is a block diagram of an exemplary embodiment of a system.

FIG. 7 is a block diagram of an exemplary embodiment of a system 6000, for which a key can be found below.

| | |
|---|---|
| 7100 | Gas Source |
| 7110 | Gas |
| 7200 | Gas Filter |
| 7210 | Filtered gas |
| 7300 | Blower |
| 7310 | Blown gas |
| 7400 | Energy Exchanger |
| 7410 | Heated gas |
| 7500 | Energy Source |
| 7510 | Energy |
| 7600 | Manifold (optional) |
| 7610 | Distributed gas |
| 7700 | Inflated Tube |
| 7710 | Delivered/supplied gas |
| 7800 | Bale Stack |
| 7810 | Humidified gas |

As seen in FIG. 7, an exemplary bale drying system 7000 can provide Gas 7110 from Gas Source 7100, which can include, but not limited to, ambient air. Gas 7110 can pass through Gas Filter 7200. Filtered gas 7210 can be supplied to Blower 7300. Blown gas 7310 can be heated by Energy Exchanger 7400. Energy Source 7500 can supply energy 7510 for heating via one or more hot gases, one or more hot thermal transfer fluids, one or more fuels, electrical power, solar energy, and/or geothermal energy. Heated gas 7410 can be supplied to Manifold 7600. Distributed (and/or "supplied") heated gas 7610 can flow from Manifold 760 and down the interior of one or more Inflated Tubes 3050 or 4050 positioned within Interstitial Channels 3020 or 4020 of a Bale Stack 3000 or 4000, respectively, and through one or more walls of Inflated Tubes 3050 or 3050. Some or all of delivered gas 7710 that is supplied through one or more walls of the Inflated Tubes 3050 or 4050 can permeate through the Bale Stack 3000 or 4000, respectively, to absorb moisture from the biomass material. The moisture absorbed from the biomass material can humidify the delivered/supplied drying gas 7710. The Humidified Gas 7810 can exit the Bale Stack 3000 or 4000, respectively, via a Humidified Gas(es) Exhaust Channel 3070 or 4070 surface, a Bale Face 3080 4080 surface, and/or a External Bale Surface 3090 or 4090, respectively, and to and/or toward ambient.

Sensors for any of temperature, moisture, humidity, flowrate, pressure, and/or other properties can be temporarily and/or permanently inserted into Gas Source 7100, Gas Filter 7200, Blower 7300, Energy Exchanger 7400, Energy Source 7500, Manifold 7600, distributed heated gas 7610, Bale Stack 3000 or 4000, Inflated Tubes 3050 or 4050, delivered gas 7710, Interstitial Channels 3020 or 4020, gaps between Inflated Tubes 3050 or 4050 and Bale Channel Surfaces 3040 or 4040, respectively, Humidified Gas(es) Exhaust Channel 3070 or 4070 surface, Bale Face 3080 or 4080 surfaces, and/or External Bale Surfaces 3090 or 4090, respectively, to measure the drying process by delivering sensor signals to a Control System. Sensors for any of temperature, moisture, humidity, flowrate, pressure, and/or other properties can be temporarily and/or permanently located outside of the Bale Stack 3000 or 4000 to measure environmental conditions that can affect the drying process, such as a humidity and/or temperature within an enclosure that at least partially surrounds Bale Stack 3000 or 4000 and/or a humidity and/or temperature of an immediately surrounding of such an enclosure. The Control System can monitor, record, control, communicate externally, and/or automate the drying process by delivering control signal(s) to Energy Exchanger 7400, Blower 7300, and/or Energy Source 7500. These control signals can function to turn on, turn off, and/or modulate the operation of system components that can include, but not limited to, Energy Exchanger 7400, Blower 7300, Manifold 7600, and/or Energy Source 7500. These controls can be performed, guided, and/or automated in accordance with a sorption equilibrium model. In certain embodiments, a drying gas pressure, temperature, flowrate, relative humidity, and/or range of relative humidity can be set as target so that supply of the drying gas to the biomass can achieve a predetermined biomass moisture and/or range of biomass moisture via a sorption equilibrium model. In certain exemplary embodiments, a biomass temperature, moisture, and/or range of biomass moisture can be set as a target that can be achieved by supplying a drying gas of a certain pressure, temperature, flowrate, relative humidity, and/or range of relative humidity via a sorption equilibrium model. In certain embodiments, Humidified Gas 7810 pressure, temperature, flowrate, relative humidity, and/or range of relative humidity can be set as target so that supply of the drying gas to the biomass can achieve a predetermined biomass moisture and/or range of biomass moisture via a sorption equilibrium model.

Certain exemplary embodiments can provide a system configured for producing dried biomass, the system comprising:

a plurality of biomass bales arranged in a bale stack, each bale from the plurality of biomass bales defining a longitudinal axis, the longitudinal axes of the plurality of biomass bales aligned substantially parallel to one another, wherein the bale stack defines a plurality of channels that longitudinally extend substantially parallel to the longitudinal axes of the plurality of biomass bales, at least a longitudinal portion of each channel from the plurality of channels defined by at least 3 adjacent biomass bales from plurality of biomass bales; and a plurality of flexible, non-destructively inflatable, non-destructively collapsible tubes, each tube from that plurality of tubes:

operably extends within a corresponding channel from the plurality of channels;

operably contacting exteriors of the biomass bales that define the corresponding channel; and operably conveys a drying gas from a drying gas supply system through an interior of the tube and to one or more exterior surfaces of each of the corresponding biomass bales;

an energy source that operably heats the drying gas prior to conveying the drying gas to the drying gas supply system;

a bale deconstructer that operably deconstructs the plurality of biomass bales into unbound biomass particles after the drying gas operably dries the plurality of biomass bales;

a biomass particle size reducer that operably reduces a size distribution of unbound biomass particles generated from the plurality of biomass bales;

a biomass particle dryer that operably reduces a moisture content of unbound biomass particles generated from the plurality of biomass bales;

a mixer that operably blends unbound biomass particles generated from the plurality of biomass bales with one or more additives selected from the group comprising: water, one or more solvents, one or more binders, one or more other biomass materials, one or more vitamins, one or more nutrients, one or more catalysts, one or more sorbents, and one or more anti-slagging agents;

a biomass densifier that operably compacts unbound biomass particles generated from the plurality of biomass bales into a plurality of densified biomass products, each of the densified biomass products having a maximum dimension of 0.002 to 0.01 meters, a specific density of 300 to 1,500 kilograms per cubic meter, and a moisture content of 4 to 24 weight percent;

a bale storage structure configured to store the plurality of biomass bales; and/or a filter configured to clean the drying gas prior to application to the plurality of biomass bales;

wherein:

between 15 percent and 85 percent of the plurality of channels serve as outlet channels that operably convey drying gas received from the exterior surfaces of the plurality of biomass bales toward ambient;

the system operably causes a moisture metric associated with the bale stack to decrease into a predetermined range.

between 35 percent and 60 percent of the plurality of channels serve as outlet channels that operably convey drying gas received from the exterior surfaces of the plurality of biomass bales toward ambient;

the drying gas operably dries the plurality of biomass bales into dried biomass bales having a predetermined dryness in a predetermined period of time;

the system operably initiates conveyance of the drying gas from the drying gas supply system when an ambient relative humidity decreases below a predetermined value; and/or the system operably controls a flowrate of drying gas into each tube and a pressure differential between an interior of each tube and an exterior of each tube.

Certain exemplary embodiments can provide a method for producing dried biomass, the method comprising:

positioning a plurality of flexible, non-destructively inflatable, non-destructively collapsible tubes in at least a portion of a plurality of channels defined by a plurality of biomass bales arranged in a bale stack, each bale from the plurality of biomass bales defining a longitudinal axis, the longitudinal axes of the plurality of biomass bales aligned substantially parallel to one another, plurality of channels that longitudinally extend substantially parallel to the longitudinal axes of the plurality of biomass bales, at least a longitudinal portion of each channel from the plurality of channels defined by at least 3 adjacent biomass bales from the plurality of biomass bales, each tube from that plurality of tubes:

operably extending within a corresponding channel from the plurality of channels;

operably contacting exteriors of the biomass bales that define the corresponding channel;

for each tube from the plurality of tubes, conveying a drying gas from a drying gas supply system through an interior of the tube and to an exterior of each of the at least 2 adjacent biomass bales from the plurality of biomass bales;

causing a moisture metric associated with one or more bales of the bale stack to drop into a predetermined range;

initiating conveyance of the drying gas from the drying gas supply system when an ambient relative humidity decreases below a predetermined value;

controlling a flowrate of drying gas into each tube and a pressure differential between an interior of each tube and an exterior of each tube;

heating the drying gas prior to conveying the drying gas to the drying gas supply system;

deconstructing the plurality of biomass bales into unbound biomass particles after the drying gas operably dries the plurality of biomass bales;

reducing a size distribution of unbound biomass particles generated from the plurality of biomass bales;

reducing a moisture content of unbound biomass particles generated from the plurality of biomass bales;

blending unbound biomass particles generated from the plurality of biomass bales with one or more additives selected from the group comprising: water, one or more solvents, one or more binders, one or more other biomass materials, one or more vitamins, one or more nutrients, one or more catalysts, one or more sorbents, and one or more anti-slagging agents;

compacting unbound biomass particles generated from the plurality of biomass bales into a plurality of densified biomass products, each of the densified biomass products having a maximum dimension of 0.003 to 0.01 meters, a specific density of 300 to 1,500 kilograms per cubic meter, and a moisture content of 4 to 24 weight percent;

storing the plurality of biomass bales; and/or cleaning the drying gas prior to application to the plurality of biomass bales;

wherein:

between 15 percent and 85 percent of the plurality of channels serve as outlet channels that operably convey drying gas received from the plurality of biomass bales toward ambient;

between 35 percent and 60 percent of the plurality of channels serve as outlet channels that operably convey drying gas received from the exterior surfaces of the plurality of biomass bales toward ambient; and/or the drying gas operably dries the plurality of biomass bales into dried biomass bales having a predetermined dryness in a predetermined period of time.

Certain exemplary embodiments can provide a system configured for producing dried biomass, the system comprising:

a plurality of biomass bales arranged in a bale stack, each bale from the plurality of biomass bales defining a longitudinal axis, the longitudinal axes of the plurality of biomass bales aligned substantially parallel to one another, wherein the bale stack defines a plurality of channels that longitudinally extend substantially parallel to the longitudinal axes of the plurality of biomass bales, at least a longitudinal portion of each channel from the plurality of channels defined by at least two adjacent biomass bales from plurality of biomass bales;

one or more flexible, non-destructively inflatable, non-destructively collapsible tubes, wherein each:

operably extends within a corresponding channel from the plurality of channels;

operably contacts exteriors of the biomass bales that define the corresponding channel;

defines a cross-sectional tube area that increases by 5% or more when the tube is inflated; and/or operably conveys a drying gas from a drying gas supply system through an interior of the tube and to one or more exterior surfaces of each of the corresponding biomass bales;

an energy source that operably heats the drying gas prior to conveying the drying gas to the drying gas supply system;

a bale deconstructer that operably deconstructs the plurality of biomass bales into unbound biomass particles after the drying gas operably dries the plurality of biomass bales;

a biomass particle size reducer that operably reduces a size distribution of unbound biomass particles generated from the plurality of biomass bales;

a biomass particle dryer that operably reduces a moisture content of unbound biomass particles generated from the plurality of biomass bales;

a mixer that operably blends unbound biomass particles generated from the plurality of biomass bales with one or more additives selected from the group comprising: water, one or more solvents, one or more binders, one or more other biomass materials, one or more vitamins, one or more nutrients, one or more catalysts, one or more sorbents, and one or more anti-slagging agents;

a biomass densifier that operably compacts unbound biomass particles generated from the plurality of biomass bales into a plurality of densified biomass products, each of the densified biomass products having a maximum dimension of 0.003 to 0.01 meters, a specific density of 300 to 1,500 kilograms per cubic meter, and a moisture content of 4 to 24 weight percent;

a bale storage structure configured to store the plurality of biomass bales; and/or a filter configured to clean the drying gas prior to application to the plurality of biomass bales;

wherein:

the system operably causes a moisture metric associated with the bale stack to decrease into a predetermined range;

between 15 percent and 85 percent of the plurality of channels serve as outlet channels that operably convey drying gas received from the exterior surfaces of the plurality of biomass bales toward ambient;

the drying gas operably dries the plurality of biomass bales into dried biomass bales having a predetermined dryness and/or within a predetermined period of time;

the system operably initiates conveyance of the drying gas from the drying gas supply system when an ambient relative humidity decreases below a predetermined value; and/or the system operably controls a flow rate of drying gas into each tube and/or a pressure differential between an interior of each tube and an exterior of each tube.

Certain exemplary embodiments can provide a method for producing dried biomass, the method comprising:

positioning a plurality of flexible, non-destructively inflatable, non-destructively collapsible tubes in at least a portion of a plurality of channels defined by a plurality of cylindrical biomass bales arranged in a bale stack, each bale from the plurality of cylindrical biomass bales defining a longitudinal axis, the longitudinal axes of the plurality of cylindrical biomass bales aligned substantially parallel to one another, the plurality of channels longitudinally extending substantially parallel to the longitudinal axes of the plurality of cylindrical biomass bales, at least a longitudinal portion of each channel from the plurality of channels defined by at least 3 adjacent cylindrical biomass bales from the plurality of cylindrical biomass bales, each tube from that plurality of tubes:

operably extending within a corresponding channel from the plurality of channels; and/or operably contacting exteriors of the cylindrical biomass bales that define the corresponding channel;

for each tube from the plurality of tubes, conveying a drying gas from a drying gas supply system through an interior of the tube and to an exterior of each of the at least 3 adjacent cylindrical biomass bales from the plurality of cylindrical biomass bales;

causing a moisture metric associated with one or more bales of the bale stack to decrease into a predetermined range;

initiating conveyance of the drying gas from the drying gas supply system when an ambient relative humidity decreases below a predetermined value;

controlling a flowrate of drying gas into each tube and a pressure differential between an interior of each tube and an exterior of each tube;

heating the drying gas prior to conveying the drying gas to the drying gas supply system;

for at least one tube from the plurality of tubes, deflating the tube to form a deflated tube, moving the deflated tube to a different channel from the plurality of channels, reinflating the deflated tube while in the different channel to form a reinflated tube, and conveying the drying gas through an interior of the reinflated tube;

deconstructing the plurality of biomass bales into unbound biomass particles after the drying gas operably dries the plurality of biomass bales;

reducing a size distribution of unbound biomass particles generated from the plurality of biomass bales;

reducing a moisture content of unbound biomass particles generated from the plurality of biomass bales;

blending unbound biomass particles generated from the plurality of biomass bales with one or more additives selected from the group comprising: water, one or more solvents, one or more binders, one or more other biomass materials, one or more vitamins, one or more nutrients, one or more catalysts, one or more sorbents, and one or more anti-slagging agents;

compacting unbound biomass particles generated from the plurality of biomass bales into a plurality of densified biomass products, each of the densified biomass products having a maximum dimension of 0.003 to 0.01 meters, a specific density of 400 to 1,600 kilograms per cubic meter, and a moisture content of 4 to 24 weight percent;

storing the plurality of biomass bales; and/or cleaning the drying gas prior to application to the plurality of biomass bales;

wherein:

between 15 percent and 85 percent of the plurality of channels serve as outlet channels that operably convey drying gas received from the plurality of cylindrical biomass bales toward ambient;

between 35 percent and 60 percent of the plurality of channels serve as outlet channels that operably convey drying gas received from the exterior surfaces of the plurality of cylindrical biomass bales toward ambient; and/or wherein the drying gas operably dries the plurality of biomass bales into dried biomass bales having a predetermined dryness in a predetermined period of time;

Definitions

When the following phrases are used substantively herein, the accompanying definitions apply. These phrases and definitions are presented without prejudice, and, consistent with the application, the right to redefine these phrases via amendment during the prosecution of this application or any application claiming priority hereto is reserved. For the purpose of interpreting a claim of any patent that claims priority hereto, each definition in that patent functions as a clear and unambiguous disavowal of the subject matter outside of that definition.

a—at least one.

about—around and/or approximately.

above—at a higher level.

acid—a compound capable of neutralizing alkalis and reddening blue litmus paper, containing hydrogen that can be replaced by a metal or an electropositive group to form a salt, or containing an atom that can accept a pair of electrons from a base. Acids are proton donors that yield hydronium ions in water solution, or electron-pair acceptors that combine with electron-pair donors or bases.

across—from one side to another.

activity—an action, act, step, and/or process or portion thereof.

adapt—to design, make, set up, arrange, shape, configure, and/or make suitable and/or fit for a specific purpose, function, use, and/or situation.

adapter—a device used to effect operative compatibility between different parts of one or more pieces of an apparatus or system.

additive—something that is added as one substance to another to alter and/or improve the quality and/or to counteract undesirable propertie adjacent—close to; lying near; next to; adjoining, and/or within a horizontal radius of approximately 0.5 to approximately 6 inches of, including all values and subranges therebetween.

after—following in time and/or subsequent to.

agent—a substance that exerts some force and/or effect and/or causes a change.

air—the earth's atmospheric gas.

align—to place objects such that at least some of their faces are in line with each other and/or so that their centerlines are parallel and/or on the same axis.

along—through, on, beside, over, in line with, and/or parallel to the length and/or direction of; and/or from one end to the other of.

ambient—pertaining to a enveloping and/or surrounding environment and/or the status thereof.

anaerobic—a condition where molecular oxygen is substantially absent.

and—in conjunction with.

and/or—either in conjunction with or in alternative to.

another—a different one.

anti-slagging—resisting the formation of slag.

any—one, some, every, and/or all without specification.

apparatus—an appliance or device for a particular purpose.

application—the act of putting something to a use and/or purpose.

approximately—about and/or nearly the same as.

area—the measure of the space within a 2-dimensional region.

around—about, surrounding, and/or on substantially all sides of; and/or approximately. arrange-to dispose in a particular order.

arrangement—a renderable visual pattern of a collection.

as long as—if and/or since.

associate—to join, connect together, and/or relate.

associated with—related to and/or accompanying.

at—in, on, and/or near.

at least—not less than, and possibly more than.

automatic-performed via an information device in a manner essentially independent of influence and/or control by a user. For example, an automatic light switch can turn on upon "seeing" a person in its "view", without the person manually operating the light switch.

axes—more than one axis.

axis—a straight line with respect to which the different parts of a magnitude are symmetrically arranged, e.g., a straight line defined perpendicular to a cylindrical and/or rectangular object's diameter and/or and passing through a centroid of the cylindrical and/or rectangular object, respectively.

bale—a compressed and bound mass of biomass material (such as corn stover, straw, hay, grass, or similar materials), typically formed by agricultural baling equipment.

bale deconstructer—a device and/or system that operably disassembles, dismantles, breaks up, and/or takes apart a bale.

based on—indicating one or more factors that affect a determination, but not necessarily foreclosing additional factors that might affect that determination.

below—beneath; in a lower place; and/or less than.

between—in a separating interval and/or intermediate to.

between—in a separating interval and/or intermediate to.

binder—a material added to biomass particles that helps adhere and/or cohere components and/or individual particles together, improve mechanical integrity, and/or enhance durability or stability of densified biomass products biomass—organic, plant, and/or animal matter, such as forestry byproducts and/or agricultural waste, that can used, such as for source of fuel, energy, food, and/or fertilizer.

biomass materials—plant-derived organic materials typically including crop residues, agricultural wastes, forestry products, grasses, and/or energy crops, which can be used as feedstock for bioenergy production, animal feed, and/or industrial purposes.

blend—to intermingle and/or combine (possibly different varieties and/or grades of the same substance) to obtain a mixture of a particular character, quality, and/or consistency.

by—via and/or with the use and/or help of.

can—is capable of, in at least some embodiments.

catalyst—a substance adapted to improve a chemical and/or electrochemical reaction rate.

cause—to bring about, provoke, precipitate, produce, elicit, be the reason for, result in, and/or effect.

channel—(v) to cause to flow via a defined passage, conduit, and/or groove adapted to convey one or more fluids. (n) a defined passage, conduit, and/or groove adapted to convey one or more fluids.

clean—(v) to rid of dirt, rubbish, and/or impurities.

cohere—to stick and/or hold together in a mass that resists separation.

collapsible—designed and constructed to be exhausted of air and/or gas sufficiently to cause a reduction of at least five percent in at least one of three orthogonal dimensions.

compact—to press and/or join firmly together.

composition of matter—a combination, reaction product, compound, mixture, formulation, material, and/or composite formed by a human and/or automation from two or more substances and/or elements.

compound—a pure, macroscopically homogeneous substance consisting of atoms or ions of two or more different elements in definite proportions that cannot be separated by physical methods. A compound usually has properties unlike those of its constituent elements.

comprising—including but not limited to.

conceive—to imagine, conceptualize, form, and/or develop in the mind.

concentration—a measure of how much of a given substance is mixed, dissolved, contained, and/or otherwise present in and/or with another substance, and/or a measure of the amount of dissolved substance contained per unit of volume and/or the amount of a specified substance in a unit amount of another substance, both measures defining a structure of a composition that comprises both substances.

configuration—a physical, logical, and/or logistical arrangement of elements, such as bales.

configure—to design, arrange, set up, shape, and/or make suitable and/or fit for a specific purpose, function, use, and/or situation.

configured to—designed, arranged, set up, shaped, and/or made suitable and/or fit for a specific purpose, function, use, and/or situation, and/or having a structure that, during operation, will perform the indicated activity (ies). To the extent relevant to the current application, the use of "configured to" is expressly not intended to invoke 35 U.S.C. § 112 (f) for that structure.

connect—to join or fasten together.

contact—to touch.

containing—including but not limited to.

control—(n) a mechanical or electronic device used to operate a machine within predetermined limits; (v) to exercise authoritative and/or dominating influence over, cause to act in a predetermined manner, direct, adjust to a requirement, and/or regulate.

convert—to transform, adapt, and/or change.

convey—to transport, guide, and/or carry.

conveyance—the act of conveying.

corresponding—related, associated, accompanying, similar in purpose and/or position, conforming in every respect, and/or equivalent and/or agreeing in amount, quantity, magnitude, quality, and/or degree.

coupleable—capable of being joined, connected, and/or linked together.

coupling—linking in some fashion.

create—to bring into being.

cross-section—a section formed by a plane cutting through an object at a right angle to an axis.

cubic meter—a metric unit of volume or capacity equal to 1000 liters.

cycle—a set of predetermined activities.

cylindrical—of, relating to, and/or having the shape of a cylinder, especially of a circular cylinder.

deconstruct—to dismantle and/or break down into components.

decrease—to become smaller in magnitude.

define—to establish the meaning, relationship, outline, form, and/or structure of;

and/or to precisely and/or distinctly describe and/or specify.

deflate—to release sufficient air and/or gas to cause a decrease of at least five percent in at least one of three orthogonal dimensions of the object.

densified product—a product formed by compressing biomass material to increase its density, reduce its volume, and/or enhance its handling and/or storage properties. Exemplary densified products include pellets, briquettes, cubes, wafers, pucks, and similar compacted forms.

densifier—an apparatus that compresses a material to reduce its volume.

densify—to make or become denser.

density—the mass per unit volume of a substance under specified conditions of pressure and temperature, such as at a standard atmosphere (i.e., a standardized value of air temperature, pressure, and/or air density).

derive—to receive, obtain, and/or produce from a source and/or origin.

determine—to find out, obtain, calculate, decide, deduce, ascertain, and/or come to a decision, typically by investigation, reasoning, and/or calculation.

device—a machine, manufacture, and/or collection thereof.

differential—a difference between two different values.

digital—non-analog and/or discrete.

dimension—a size and/or an extension in a given direction and/or a measurement in length, width, or thickness.

distribution—a set of data, events, occurrences, outcomes, objects, and/or entities and their frequency of occurrence collected from measurements over a statistical population.

dried—having had a fluid, such as liquid and/or vaporous water removed, at least partially therefrom.

dry—(n) marked by the reduction of and/or absence of natural and/or normal moisture; (v) to reduce and/or remove moisture and/or wetness.

dry matter loss—reduction in biomass weight due to biological degradation processes, primarily microbial decomposition during storage periods.

drying gas—a gaseous medium (typically air, but can also include other gases) used to remove moisture from baled biomass materials through convection, evaporation, diffusion, and/or other drying mechanisms.

dryness—a measure of moisture content.

durability—a measure of the mechanical integrity and/or resistance to physical breakdown, fragmentation, abrasion, and/or degradation during handling, storage, transportation, and/or usage of densified biomass products.

each—every one of a group considered individually.

effective—sufficient to bring about, provoke, elicit, and/or cause.

elemental—of, relating to, or denoting a chemical element.

embodiment—an implementation, manifestation, and/or concrete representation.

enclosure—a structure designed to partially or fully surround and protect biomass bale stacks from environmental conditions such as moisture ingress (e.g., precipitation, humidity, and/or groundwater), physical damage, and/or exposure to weather elements.

energy density—the amount of energy stored per unit mass or volume of biomass material.

energy source—a system adapted to provide usable power and/or energy.

estimate—(n) a calculated value approximating an actual value; (v) to calculate and/or determine approximately and/or tentatively.

exemplary—serving as an example, instance, and/or illustration.

extend—to stretch, cover, span, and/or reach and/or move spatially outward and/or away from.

exterior—outside of, defined by an outer surface of, facing outside of, external to, and/or substantially non-interior.

filter—a permeable material through which a fluid is passed in order to separate the constituent liquid and/or gas from particulate matter suspended therein.

first—a label for a referenced element in one or more patent claims, but that label does not necessarily imply any type of ordering to how that element (or any other elements of a similar type) is implemented in embodiments of the claimed subject matter.

flexible—capable of bending at least 30 degrees from its longitudinal axis without a tendency to break.

flow rate—the amount of fluid that flows in a given time.

for—with a purpose of.

from—used to indicate a source, origin, and/or location thereof.

further—in addition.

gas—a substance in a gaseous state, that is, in a state of matter distinguished from the solid and liquid states by relatively low density and viscosity, relatively great expansion and contraction with changes in pressure and temperature, the ability to diffuse readily, and the spontaneous tendency to become distributed uniformly throughout any container; and/or a substance in a gaseous state.

generate—to create, build, form, manufacture, result in, produce, give rise to, and/or bring into existence.

given—identified, specified, selected, fixed, particular, and/or previously stated.

group—(n.) a number of individuals and/or things considered together because of similarities; (v.) to associate a number of individuals and/or things such that they are considered together and/or caused to have similar properties.

having—including but not limited to.

heat—(v) to transfer energy from one substance (and/or object) to another resulting in an increase in temperature of one substance (and/or object).

humidity—a measure of the amount of moisture in the air.

including—including but not limited to.

increase—to become greater or more in size, quantity, number, degree, value, intensity, and/or power, etc.

inflate—to add sufficient air and/or gas to cause an increase of at least five percent in at least one of three orthogonal dimensions of the object.

inflatable—a characteristic of an object whereby the object is designed and constructed to be filled with air and/or gas sufficiently to cause an increase of at least five percent in at least one of three orthogonal dimensions of the object.

initialize—to prepare something for use and/or some future event.

initiate—to begin.

install—to connect or set in position and prepare for use.

instructions—directions, which can be implemented as hardware, firmware, and/or software, the directions adapted to perform a particular operation and/or function via creation and/or maintenance of a predetermined physical circuit.

interior—of, relating to, or located on the within and/or inside.

into—to a condition, state, or form of.

is—to exist in actuality.

kilogram—a standard unit of mass.

least—not less than, and possibly more than.

logical—a conceptual representation.

longitudinal—of and/or relating to a length; placed and/or running lengthwise.

longitudinal axis—a straight line defined parallel to an object's length and passing through a centroid of the object.

manmade—a tangible physical item that is synthetic and/or made by humans rather than occurring in nature.

mass-to-mass ratio—the mass of a first substance expressed with respect to the mass of a second substance.

material—a substance of which a thing was, is, and/or can be made and/or composed; a component and/or constituent matter.

maximum—a greatest extent.

may—is allowed and/or permitted to, in at least some embodiments.

medium—any substance or material, such as one or more solids, liquids, vapors, fluids, water, and/or air, etc.

meter—a device adapted to detect and/or record a measured value.

method—one or more acts that are performed upon subject matter to be transformed to a different state or thing and/or are tied to a particular apparatus, said one or more acts not a fundamental principal and not preempting all uses of a fundamental principal.

metric—a calculated and/or measured value.

microbial decomposition—biological breakdown of biomass material by microorganisms, such as bacteria, fungi, and/or molds, which can lead to loss of mass, reduced quality, spoilage, and/or rot.

milligram—One one-thousandth of a gram.

mix—to combine and/or blend into one mass, stream, and/or mixture.

mixer—a device that blends and/or mixes one or more substances and/or ingredients especially by mechanical agitation.

moisture—diffuse wetness that can be felt as vapor in the atmosphere and/or condensed liquid on the surfaces of objects; dampness.

moisture content—the amount of water contained in biomass, typically expressed as a percentage of the total weight or dry matter weight.

molecule—the smallest particle of a substance that retains the chemical and physical properties of the substance and is composed of two or more atoms;

and/or a group of like or different atoms held together by chemical forces.

more—a quantifier meaning greater in size, amount, extent, and/or degree.

move—to relocate, reposition, translate, and/or rotate.

near—a distance of less than approximately [X].

no—an absence of and/or lacking any.

non-destructively—to perform without damaging and/or to perform once without negating the ability to perform again.

nutrient—a substance that provides nourishment.

nutrient density—concentration or amount of nutrients per unit mass or volume of biomass material, relevant particularly in contexts such as animal feed.

one—being and/or amounting to a single unit, individual, and/or entire thing, item, and/or object.

operable—practicable and/or fit, ready, and/or configured to be put into its intended use and/or service.

operative—when in operation for its intended use and/or service.

or—a conjunction used to indicate alternatives, typically appearing only before the last item in a group of alternative items.

organic—a compound containing carbon, which is further characterized by the presence in the molecule of two carbon atoms bonded together; or one atom of carbon bonded to at least one atom of hydrogen or halogen; or one atom of carbon bonded to at least one atom of nitrogen by a single or double bond.

other—a different and/or distinct entity and/or not the same as already mentioned and/or implied.

outlet—a passage for escape and/or exit; a vent.

outside—beyond a range, boundary, and/or limit; and/or not within.

parallel—of, relating to, and/or designating lines, curves, planes, and/or surfaces everywhere equidistant.

particle—a relatively small piece and/or part of a whole that can be and/or be comprised by a shred, powder, bead, crumb, crystal, dust, grain, grit, meal, pounce, pulverulence, seed, etc.

per—for each and/or by means of.

percent—one part in one hundred.

perceptible—capable of being perceived by the human senses.

period—a time interval.

perpendicular—intersecting at or forming substantially right angles.

pH—a measure representing the base 10 logarithm of the reciprocal of hydrogen ion concentration in gram atoms per liter, used to express the acidity or alkalinity of a solution on a scale of 0 to 14, where less than 7 represents acidity, 7 neutrality, and more than 7 alkalinity.

physical—tangible, real, and/or actual.

physically—existing, happening, occurring, acting, and/or operating in a manner that is tangible, real, and/or actual.

plurality—the state of being plural and/or more than one.

portion—a part, component, section, percentage, ratio, and/or quantity that is less than a larger whole.

position—(n) a place and/or location, often relative to a reference point; (v) to place and/or locate.
ppm—parts per million.
pre—a prefix that precedes an activity that has occurred beforehand and/or in advance.
predetermine—to determine, decide, and/or establish in advance.
pressure—a measure of force applied uniformly over a surface.
prevent—to hinder, avert, and/or keep from occurring.
prior—before and/or preceding in time or order.
prior to—before.
probability—a quantitative representation of a likelihood of an occurrence.
produce—to create, generate, manufacture, and/or make via a physical effort.
product—something produced by human and/or mechanical effort.
project—to calculate, estimate, or predict.
provide—to furnish, supply, give, and/or make available.
pure—having a substantially homogeneous and/or uniform composition, not mixed, and/or substantially free of foreign substances.
range—a measure of an extent of a set of values and/or an amount and/or extent of variation.
ratio—a relationship between two quantities expressed as a quotient of one divided by the other.
re-activate—to make active again and/or to restore the ability to function and/or the effectiveness of.
react—to cause (a substance or substances) to undergo a reaction.
reactants—substances that react in a chemical reaction.
reaction—a change and/or transformation in which a substance decomposes, combines with other substances, and/or interchanges constituents with other substances.
reaction product—something produced by a chemical reaction.
receive—to gather, take, acquire, obtain, accept, get, and/or have bestowed upon.
recommend—to suggest, praise, commend, and/or endorse.
reduce—to make and/or become lesser and/or smaller.
reducer—a device and/or system that operably reduces a size of an object and/or material it operates on. Examples include mills, grinders, shredders, crushers, pulverizers, etc.
reinflate—to inflate again.
relative humidity—the ratio of the amount of water vapor in the air (or corresponding gas) at a specific temperature to the maximum amount that the air (or corresponding gas) could hold at that temperature, expressed as a percentage.
remove—to eliminate, remove, and/or delete, and/or to move from a place or position occupied.
repeat—to do again and/or perform again.
repeatedly—again and again; repetitively.
request—to express a desire for and/or ask for.
result—(n.) an outcome and/or consequence of a particular action, operation, and/or course; (v.) to cause an outcome and/or consequence of a particular action, operation, and/or course.
said—when used in a system or device claim, an article indicating a subsequent claim term that has been previously introduced.
saturated—full and/or unable to hold and/or contain more.
second—a label for an element in one or more patent claims, the element other than a "first" referenced element of a similar type, but the label does not necessarily imply any type of ordering to how that "second" element or the "first" element is implemented in embodiments of the claimed subject matter.
select—to make a choice or selection from alternatives.
selected—a chosen item.
serve—to be used by.
set—a related plurality.
size—(n) physical dimensions, proportions, magnitude, amount, and/or extent of
an entity; (v) to determine physical dimensions, proportions, magnitude, amount, and/or extent of an entity.
slag—(n) a substantially fused and/or vitrified matter separated during the reduction of a metal from its ore.
solvent—a substance that dissolves another to form a solution
sorbent—a material that collects molecules by sorption.
species—a class of individuals and/or objects grouped by virtue of their common attributes and assigned a common name; a division subordinate to a genus.
specific—characterized by being described, characterized, indicated, and/or stated explicitly and/or in detail.
spent—used up, consumed, exhausted, and/or depleted of effectiveness.
stack—(n) a substantially orderly pile, group, sequence, and/or linear arrangement of articles, especially one arranged in and/or defined by layers; (v) to place and/or arrange in a stack.
state—a qualitative and/or quantitative description of condition.
storage—a space for reserving and/or putting away goods, items, devices, objects, etc.
store—to deposit, receive, place, collect, keep, save, hold, accumulate, and/or retain mass and/or data.
stream—a steady current of a fluid.
structure—that which is complexly constructed, such as a building and/or an addition to a building.
substantially—to a great extent and/or degree.
supply—to make available for use.
support—to bear the weight of, especially from below.
surface—the outer boundary of an object and/or a material layer constituting and/or resembling such a boundary.
switch—(v) to: form, open, and/or close one or more circuits; form, complete, and/or break an electrical and/or informational path; select a path and/or circuit from a plurality of available paths and/or circuits; and/or establish a connection between disparate transmission path segments in a network (or between networks); (n) a physical device, such as a mechanical, electrical, and/or electronic device, that is adapted to switch.
system—a collection of mechanisms, devices, machines, articles of manufacture, processes, data, and/or instructions, the collection designed to perform one or more specific functions.
that—used as the subject or object of a relative clause.
through—across, among, between, and/or in one side and out the opposite and/or another side of.
time—a measurement of a point in a nonspatial continuum in which events occur in apparently irreversible succession from the past through the present to the future.
to—a preposition adapted for use for expressing purpose.

toward—used to indicate a destination and/or in a physical and/or fluidic direction of; in a direction of.

transform—to change in measurable: form, appearance, nature, and/or character.

transmit—to send as a signal, provide, furnish, and/or supply.

treatment—an act, manner, or method of handling and/or dealing with someone and/or something.

tube—hollow cylinder consisting of a wall shaped in the form of a simple closed curve and extending axially and/or longitudinally, thereby providing a conduit throughout its length, and/or an elongate member having a longitudinal axis and defining, at least when inflated, a longitudinal cross-section resembling any closed shape such as, for example, a circle, a non-circle such as an oval (which generally can include a shape that is substantially in the form of an obround, ellipse, limaçon, cardioid, cartesian oval, and/or Cassini oval, etc), and/or a polygon such as a triangle, rectangle, square, hexagon, the shape of the letter "D", the shape of the letter "P", etc. Thus, a hollow and/or annular right circular cylinder is one form of a tube, a hollow and/or annular elliptic cylinder is another form of a tube having an elliptical longitudinal cross—section, and a hollow and/or annular generalized cylinder is yet another form of a tube. The wall might vary along its axial length in transverse dimensions and/or shape.

unbound—released and/or freed from bonds and/or restraints that define a bale.

upon—immediately or very soon after; and/or on the occasion of.

use—to put into service.

value—a measured, provided, assigned, determined, and/or calculated quantity and/or quality for a variable and/or parameter.

via—by way of and/or utilizing.

vitamin—any of various fat-soluble or water-soluble organic substances that are essential in minute amounts for normal growth and/or activity of certain living organisms.

water—a transparent, odorless, tasteless liquid containing approximately 11.188 percent hydrogen and approximately 88.812 percent oxygen, by weight, characterized by the chemical formula H2O, and, at standard pressure (approximately 14.7 psia), freezing at approximately 32° F. or OC and boiling at approximately 212° F. or 100 C.

weight—a force with which a body is attracted to Earth or another celestial body, equal to the product of the object's mass and the acceleration of gravity; and/or a factor and/or value assigned to a number in a computation, such as in determining an average, to make the number's effect on the computation reflect its importance, significance, preference, impact, etc.

when—at a time and/or during the time at which.

wherein—in regard to which; and; and/or in addition to.

while—for as long as, during some or the entire portion of the time that, and/or at the same time that.

with—accompanied by.

with regard to—about, regarding, relative to, and/or in relation to.

with respect to—about, regarding, relative to, and/or in relation to.

within—inside the limits of.

zone—a region and/or volume having at least one predetermined boundary.

Note

Various substantially and specifically practical and useful exemplary embodiments of the claimed subject matter are described herein, textually and/or graphically, including the best mode, if any, known to the inventor(s), for implementing the claimed subject matter by persons having ordinary skill in the art. References herein to "in one embodiment", "in an embodiment", or the like do not necessarily refer to the same embodiment.

Any of numerous possible variations (e.g., modifications, augmentations, embellishments, refinements, and/or enhancements, etc.), details (e.g., species, aspects, nuances, and/or elaborations, etc.), and/or equivalents (e.g., substitutions, replacements, combinations, and/or alternatives, etc.) of one or more embodiments described herein might become apparent upon reading this document to a person having ordinary skill in the art, relying upon his/her expertise and/or knowledge of the entirety of the art and without exercising undue experimentation. The inventor(s) expects any person having ordinary skill in the art, after obtaining authorization from the inventor(s), to implement such variations, details, and/or equivalents as appropriate, and the inventor(s) therefore intends for the claimed subject matter to be practiced other than as specifically described herein. Accordingly, as permitted by law, the claimed subject matter includes and covers all variations, details, and equivalents of that claimed subject matter. Moreover, as permitted by law, every combination of the herein described characteristics, functions, activities, substances, and/or structural elements, and all possible variations, details, and equivalents thereof, is encompassed by the claimed subject matter unless otherwise clearly indicated herein, clearly and specifically disclaimed, or otherwise clearly unsuitable, inoperable, or contradicted by context.

The use of any and all examples, or exemplary language (e.g., "such as") provided herein, is intended merely to better illuminate one or more embodiments and does not pose a limitation on the scope of any claimed subject matter unless otherwise stated. No language herein should be construed as indicating any non-claimed subject matter as essential to the practice of the claimed subject matter.

Thus, regardless of the content of any portion (e.g., title, field, background, summary, description, abstract, drawing figure, etc.) of this document, unless clearly specified to the contrary, such as via explicit definition, assertion, or argument, or clearly contradicted by context, with respect to any claim, whether of this document and/or any claim of any document claiming priority hereto, and whether originally presented or otherwise:

- there is no requirement for the inclusion of any particular described characteristic, function, activity, substance, or structural element, for any particular sequence of activities, for any particular combination of substances, or for any particular interrelationship of elements;
- no described characteristic, function, activity, substance, or structural element is "essential"; and
- within, among, and between any described embodiments:
  - any two or more described substances can be mixed, combined, reacted, separated, and/or segregated;
  - any described characteristic, function, activity, substance, component, and/or structural element, or any combination thereof, can be specifically included, duplicated, excluded, combined, reordered, reconfigured, integrated, and/or segregated;
  - any described interrelationship, sequence, and/or dependence between any described characteristics, functions, activities, substances, components, and/or structural elements can be omitted, changed, varied, and/or reordered;

any described activity can be performed manually, semi-automatically, and/or automatically;

any described activity can be repeated, performed by multiple entities, and/or performed in multiple jurisdictions.

The use of the terms "a", "an", "said", "the", and/or similar referents in the context of describing various embodiments (especially in the context of the following claims) are to be construed to cover both the singular and the plural, unless otherwise indicated herein or clearly contradicted by context.

The terms "comprising," "having," "including," and "containing" are to be construed as open-ended terms (i.e., meaning "including, but not limited to,") unless otherwise noted.

When any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate sub-range defined by such separate values is incorporated into the specification as if it were individually recited herein. For example, if a range of 1 to 10 is described, that range includes all values therebetween, such as for example, 1.1, 2.5, 3.335, 5, 6.179, 8.9999, etc., and includes all sub-ranges therebetween, such as for example, 1 to 3.65, 2.8 to 8.14, 1.93 to 9, etc., even if those specific values or specific sub-ranges are not explicitly stated.

When any phrase (i.e., one or more words) appearing in a claim is followed by a drawing element number, that drawing element number is exemplary and non-limiting on claim scope.

No claim or claim element of this document is intended to invoke 35 USC 112 (f) unless the precise phrase "means for" is followed by a gerund.

Any information in any material (e.g., a United States patent, United States patent application, book, article, web page, etc.) that has been incorporated by reference herein, is incorporated by reference herein in its entirety to its fullest enabling extent permitted by law yet only to the extent that no conflict exists between such information and the other definitions, statements, and/or drawings set forth herein. In the event of such conflict, including a conflict that would render invalid any claim herein or seeking priority hereto, then any such conflicting information in such material is specifically not incorporated by reference herein. Any specific information in any portion of any material that has been incorporated by reference herein that identifies, criticizes, or compares to any prior art is not incorporated by reference herein.

Applicant intends that each claim presented herein and at any point during the prosecution of this application, and in any application that claims priority hereto, defines a distinct patentable invention and that the scope of that invention must change commensurately if and as the scope of that claim changes during its prosecution. Thus, within this document, and during prosecution of any patent application related hereto, any reference to any claimed subject matter is intended to reference the precise language of the then-pending claimed subject matter at that particular point in time only.

Accordingly, every portion (e.g., title, field, background, summary, description, abstract, drawing figure, etc.) of this document, other than the claims themselves and any provided definitions of the phrases used therein, is to be regarded as illustrative in nature, and not as restrictive. The scope of subject matter protected by any claim of any patent that issues based on this document is defined and limited only by the precise language of that claim (and all legal equivalents thereof) and any provided definition of any phrase used in that claim, as informed by the context of this document when reasonably interpreted by a person having ordinary skill in the relevant art.

What is claimed is:

1. A system configured for producing dried biomass, the system comprising:

a plurality of biomass bales arranged in a bale stack, each bale from the plurality of biomass bales defining a longitudinal axis and thus the plurality of biomass bales define longitudinal axes, the longitudinal axes of the plurality of biomass bales aligned substantially parallel to one another, wherein the bale stack defines a plurality of channels that longitudinally extend substantially parallel to the longitudinal axes of the plurality of biomass bales, at least a longitudinal portion of each channel from the plurality of channels defined by at least two adjacent biomass bales from plurality of biomass bales; and one or more flexible, non-destructively inflatable, non-destructively collapsible tubes, wherein each:

operably extends within a corresponding channel from the plurality of channels;

operably contacts exteriors of the biomass bales that define the corresponding channel;

defines a cross-sectional tube area that increases by 5% or more when the tube is inflated; and operably conveys a drying gas from a drying gas supply system through an interior of the tube and to one or more exterior surfaces of each of the corresponding biomass bales;

wherein:

the system operably causes a moisture metric associated with the bale stack to decrease into a predetermined range.

2. The system of claim 1, wherein between 15 percent and 85 percent of the plurality of channels serve as outlet channels that operably convey drying gas received from the exterior surfaces of the plurality of biomass bales toward ambient.

3. The system of claim 1, wherein the drying gas operably dries the plurality of biomass bales into dried biomass bales having a predetermined dryness and/or within a predetermined period of time.

4. The system of claim 1, wherein the system operably initiates conveyance of the drying gas from the drying gas supply system when an ambient relative humidity decreases below a predetermined value.

5. The system of claim 1, wherein the system operably controls a flow rate of drying gas into each tube and/or a pressure differential between an interior of each tube and an exterior of each tube.

6. The system of claim 1, further comprising an energy source that operably heats the drying gas prior to conveying the drying gas to the drying gas supply system.

7. The system of claim 1, further comprising a bale deconstructer that operably deconstructs the plurality of biomass bales into unbound biomass particles after the drying gas operably dries the plurality of biomass bales.

8. The system of claim 1, further comprising a biomass particle size reducer that operably reduces a size distribution of unbound biomass particles generated from the plurality of biomass bales.

9. The system of claim 1, further comprising a biomass particle dryer that operably reduces a moisture content of unbound biomass particles generated from the plurality of biomass bales.

10. The system of claim 1, further comprising a mixer that operably blends unbound biomass particles generated from the plurality of biomass bales with one or more additives selected from the group comprising: water, one or more solvents, one or more binders, one or more other biomass materials, one or more vitamins, one or more nutrients, one or more catalysts, one or more sorbents, and one or more anti-slagging agents.

11. The system of claim 1, further comprising a biomass densifier that operably compacts unbound biomass particles generated from the plurality of biomass bales into a plurality of densified biomass products, each of the densified biomass products having a maximum dimension of 0.003 to 0.01 meters, a specific density of 300 to 1,500 kilograms per cubic meter, and a moisture content of 4 to 24 weight percent.

12. The system of claim 1, further comprising a bale storage structure configured to store the plurality of biomass bales.

13. The system of claim 1, further comprising a filter configured to clean the drying gas prior to application to the plurality of biomass bales.

14. A method for producing dried biomass, the method comprising: positioning a plurality of flexible, non-destructively inflatable, non-destructively collapsible tubes in at least a portion of a plurality of channels defined by a plurality of cylindrical biomass bales arranged in a bale stack, each bale from the plurality of cylindrical biomass bales defining a longitudinal axis and thus the plurality of cylindrical biomass bales define longitudinal axes, the longitudinal axes of the plurality of cylindrical biomass bales aligned substantially parallel to one another, the plurality of channels longitudinally extending substantially parallel to the longitudinal axes of the plurality of cylindrical biomass bales, at least a longitudinal portion of each channel from the plurality of channels defined by at least 3 adjacent cylindrical biomass bales from the plurality of cylindrical biomass bales, each tube from that plurality of tubes:

operably extending within a corresponding channel from the plurality of channels;

operably contacting exteriors of the cylindrical biomass bales that define the corresponding channel;

for each tube from the plurality of tubes, conveying a drying gas from a drying gas supply system through an interior of the tube and to an exterior of each of the at least 3 adjacent cylindrical biomass bales from the plurality of cylindrical biomass bales;

causing a moisture metric associated with one or more bales of the bale stack to decrease into a predetermined range;

wherein between 15 percent and 85 percent of the plurality of channels serve as outlet channels that operably convey drying gas received from the plurality of cylindrical biomass bales toward ambient.

15. The method of claim 14, wherein between 35 percent and 60 percent of the plurality of channels serve as outlet channels that operably convey drying gas received from the exterior surfaces of the plurality of cylindrical biomass bales toward ambient.

16. The method of claim 14, wherein the drying gas operably dries the plurality of biomass bales into dried biomass bales having a predetermined dryness in a predetermined period of time.

17. The method of claim 14, further comprising initiating conveyance of the drying gas from the drying gas supply system when an ambient relative humidity decreases below a predetermined value.

18. The method of claim 14, further comprising controlling a flowrate of drying gas into each tube and a pressure differential between an interior of each tube and an exterior of each tube.

19. The method of claim 14, further comprising heating the drying gas prior to conveying the drying gas to the drying gas supply system.

20. The method of claim 14, further comprising, for at least one tube from the plurality of tubes, deflating the tube to form a deflated tube, moving the deflated tube to a different channel from the plurality of channels, reinflating the deflated tube while in the different channel to form a reinflated tube, and conveying the drying gas through an interior of the reinflated tube.

21. The method of claim 14, further comprising deconstructing the plurality of biomass bales into unbound biomass particles after the drying gas operably dries the plurality of biomass bales.

22. The method of claim 14, further comprising reducing a size distribution of unbound biomass particles generated from the plurality of biomass bales.

23. The method of claim 14, further comprising reducing a moisture content of unbound biomass particles generated from the plurality of biomass bales.

24. The method of claim 14, further comprising blending unbound biomass particles generated from the plurality of biomass bales with one or more additives selected from the group comprising: water, one or more solvents, one or more binders, one or more other biomass materials, one or more vitamins, one or more nutrients, one or more catalysts, one or more sorbents, and one or more anti-slagging agents.

25. The method of claim 14, further comprising compacting unbound biomass particles generated from the plurality of biomass bales into a plurality of densified biomass products, each of the densified biomass products having a maximum dimension of 0.003 to 0.01 meters, a specific density of 400 to 1,600 kilograms per cubic meter, and a moisture content of 4 to 24 weight percent.

26. The method of claim 14, further comprising storing the plurality of biomass bales.

27. The method of claim 14, further comprising cleaning the drying gas prior to application to the plurality of biomass bales.

* * * * *